US010704189B2

(12) United States Patent
Christensen et al.

(10) Patent No.: US 10,704,189 B2
(45) Date of Patent: Jul. 7, 2020

(54) LAUNDRY APPLIANCE HAVING AN ULTRASONIC DRYING MECHANISM

(71) Applicant: WHIRLPOOL CORPORATION, Benton Harbor, MI (US)

(72) Inventors: Mark J. Christensen, Stevensville, MI (US); Donald Erickson, Stevensville, MI (US); Jordan M. Grider, Farmington Hills, MI (US); Alexander Halbleib, St. Joseph, MI (US); Christopher A. Hartnett, Benton Harbor, MI (US); Christopher A. Jones, St. Joseph, MI (US); K. David McAllister, Stevensville, MI (US); Rodney M. Welch, Eau Claire, MI (US); Erica L. Roberts, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 25 days.

(21) Appl. No.: 16/059,671

(22) Filed: Aug. 9, 2018

(65) Prior Publication Data

US 2019/0062985 A1 Feb. 28, 2019

Related U.S. Application Data

(60) Provisional application No. 62/550,087, filed on Aug. 25, 2017.

(51) Int. Cl.
*D06F 58/26* (2006.01)
*D06F 25/00* (2006.01)
(Continued)

(52) U.S. Cl.
CPC ..... *D06F 58/26* (2013.01); *D06F 25/00* (2013.01); *D06F 58/30* (2020.02); *D06F 33/00* (2013.01); *D06F 37/06* (2013.01); *D06F 58/04* (2013.01)

(58) Field of Classification Search
CPC ..... D06F 58/04; D06F 58/28; D06F 58/26; D06F 25/00; D06F 33/02; D06F 37/06
(Continued)

(56) References Cited

U.S. PATENT DOCUMENTS 2,511,839 A * 6/1950 Frye ..... D06F 58/26 34/255
2,886,618 A * 5/1959 Hiroshi ..... H01L 35/16 136/204
(Continued)

FOREIGN PATENT DOCUMENTS

EP 2770100 B1 * 4/2016 ..... F26B 21/06
EP 3441515 A1 * 2/2019 ..... D06F 39/04
(Continued)

*Primary Examiner* — Stephen M Gravini
(74) *Attorney, Agent, or Firm* — Price Heneveld LLP

(57) ABSTRACT

A laundry appliance includes a cabinet having a rotating drum operably positioned therein for processing fabric. At least one transducer is positioned proximate the drum that provides an ultrasonic resonance that is directed into an interior chamber of the drum. The ultrasonic resonance is adapted to be directed into damp fabric being treated within the interior chamber. The ultrasonic resonance serves to modify water trapped within the damp fabric into a substantially gaseous form.

20 Claims, 23 Drawing Sheets

(51) Int. Cl.
*D06F 58/30* (2020.01)
*D06F 58/04* (2006.01)
*D06F 37/06* (2006.01)
*D06F 33/00* (2020.01)

(58) Field of Classification Search
USPC ..... 34/263, 595–610
See application file for complete search history.

(56) References Cited

U.S. PATENT DOCUMENTS 3,203,107 A * 8/1965 Scofield ..... D06F 58/28 34/550
3,410,116 A * 11/1968 Levinson ..... A47L 15/13 68/3 R
5,724,750 A * 3/1998 Burress ..... D06F 58/02 34/267
6,327,994 B1 * 12/2001 Labrador ..... B01D 61/10 114/382
7,017,282 B2 * 3/2006 Pyo ..... D06F 58/24 34/596
7,526,879 B2 * 5/2009 Bae ..... D06F 58/206 34/239
8,826,561 B2 9/2014 Wisherd et al.
8,943,705 B2 2/2015 Wisherd et al.
9,447,537 B2 9/2016 Wisherd et al.
9,746,238 B2 * 8/2017 Lim ..... F26B 21/06
2014/0325865 A1 * 11/2014 Wisherd ..... D06F 5/266 34/255
2019/0048509 A1 * 2/2019 Kim ..... D06F 23/04
2019/0048510 A1 * 2/2019 Kim ..... D06F 37/267
2019/0048511 A1 * 2/2019 Kim ..... H05B 6/102
2019/0048517 A1 * 2/2019 Park ..... D06F 58/26
2019/0062985 A1 * 2/2019 Christensen ..... D06F 25/00
2019/0161906 A1 * 5/2019 Berdut-Teruel ..... D06F 58/26
2019/0338455 A1 * 11/2019 Garnek ..... D06F 37/06

FOREIGN PATENT DOCUMENTS

KR 20140104304 A * 8/2014 ..... D06F 25/00
WO WO-2014129770 A1 * 8/2014 ..... D06F 25/00
WO 2016182832 11/2016
WO WO-2019031885 A1 * 2/2019 ..... D06F 39/04

* cited by examiner

LAUNDRY APPLIANCE HAVING AN ULTRASONIC DRYING MECHANISM

CROSS-REFERENCE TO RELATED APPLICATION

This application claims priority to and the benefit under 35 U.S.C. § 119(e) of U.S. Provisional Patent Application No. 62/550,087 filed on Aug. 25, 2017, entitled "LAUNDRY APPLIANCE HAVING AN ULTRASONIC DRYING MECHANISM," the entire disclosure of which is hereby incorporated herein by reference.

BACKGROUND

The present device generally relates to laundry appliances, and more specifically, to laundry appliances that use an ultrasonic resonance or vibration to remove moisture from fabric.

SUMMARY

In at least one aspect, a laundry appliance includes a cabinet having a rotating drum operably positioned therein for processing fabric. At least one transducer is positioned proximate the drum that provides an ultrasonic resonance that is directed into an interior chamber of the drum. The ultrasonic resonance is adapted to be directed into damp fabric being treated within the interior chamber. The ultrasonic resonance serves to modify water trapped within the damp fabric into a substantially gaseous form.

In at least another aspect, a laundry appliance includes a cabinet having a fabric treating chamber operably positioned therein for processing fabric. Transducers are positioned proximate the fabric treating chamber that provide an ultrasonic resonance that is directed into the fabric treating chamber. An air handling system operates cooperatively with the transducers to remove at least humidified air from the fabric treating chamber. The ultrasonic resonance is selectively adjustable between a plurality of operational frequencies that are directed into damp fabric being treated within the fabric treating chamber. The ultrasonic resonance serves to modify water trapped within the damp fabric into the humidified air.

In at least another aspect, a laundry appliance includes a cabinet having a drum operably positioned therein for processing fabric. The drum has a rotational portion and a stationary portion. A plurality of transducers is disposed proximate at least the stationary portion and provides an ultrasonic resonance that is directed into a fabric treating chamber of the drum. An air handling system operates cooperatively with the plurality of transducers and the rotating portion of the drum to remove at least humidified air from the fabric treating chamber. The ultrasonic resonance is adapted to be directed into damp fabric being treated within the fabric treating chamber. The ultrasonic resonance serves to modify water trapped within the damp fabric into the humidified air.

These and other features, advantages, and objects of the present device will be further understood and appreciated by those skilled in the art upon studying the following specification, claims, and appended drawings.

DETAILED DESCRIPTION OF EMBODIMENTS

Figure 1:
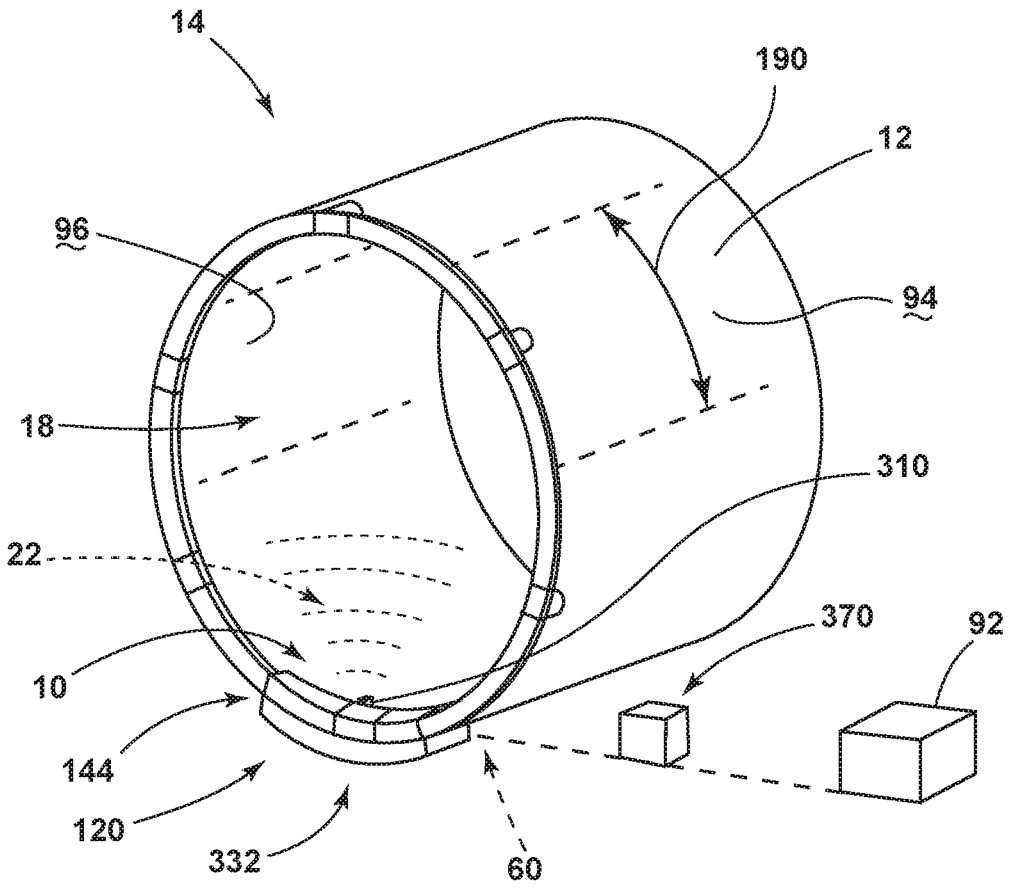
FIG. 1 is a perspective view of a drum for a laundry appliance incorporating an ultrasonic drying device.
Figure 2:
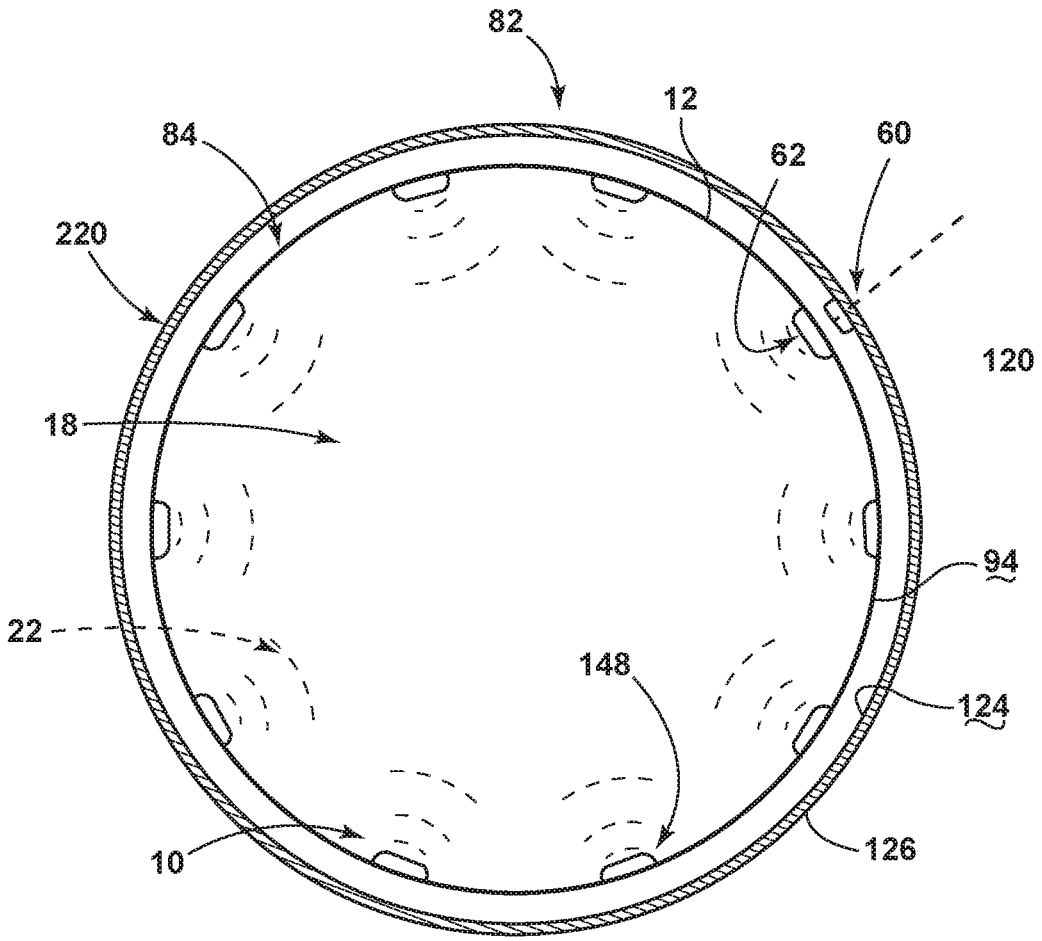
FIG. 2 is a cross-sectional view of a drum that incorporates an ultrasonic drying device.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As illustrated in FIGS. 1-6, reference numeral 10 generally refers to an ultrasonic transducer 10, or similar ultrasonic device, that is incorporated within a drum 12 for a drying appliance 14 for removing entrapped water 16 from various fabrics and other materials that are treated within the interior chamber 18 of the drum 12. The laundry appliance 14 includes a cabinet 20 (shown in dashed line at FIG. 5) having a rotating drum 12 that is operably positioned within the cabinet 20 for processing damp fabric such as clothing, linens, and other fabric-type materials. At least one ultrasonic transducer 10 is positioned within the area of the drum 12. The ultrasonic transducer 10 makes up at least a portion of the ultrasonic device and provides an ultrasonic resonance 22, typically in the form of a vibration, harmonic, sound wave, or other similar resonating disturbance that is directed into a load 24 of damp fabric being processed within the interior chamber 18 of the drum 12. The ultrasonic resonance 22 is adapted to be transmitted or directed into the interior chamber 18 of the drum 12 so that the ultrasonic resonance 22 serves to modify, disturb, or otherwise manipulate entrapped water 16 that is held within the damp fabric items of the load 24. The ultrasonic resonance 22 disrupts the entrapped water 16 and modifies the water into a substantially gaseous form, such as fine mist 40 made up of minute droplets of water. The substantially gaseous form of the water can be easily moved via an air handling system 42 from the interior chamber 18 of the drum 12 into a separate portion of the appliance 14 outside of the drum 12, and, eventually, outside of the cabinet 20 for the appliance 14.

The ultrasonic resonance 22 is generated by the ultrasonic transducer 10 and typically by a plurality of ultrasonic transducers 10 disposed within the drum 12. The ultrasonic resonance 22 can typically be in the form of an ultrasonic vibration that disrupts the entrapped water 16 into ultrafine droplets of water that can be dispersed to the air within the interior chamber 18 of the drum 12. These ultrafine droplets of air can take the form of a fine mist 40 or a collection of visible humidity within the interior chamber 18 of the drum 12.

Additionally, various aspects of the device can utilize Radio-Frequency (RF) drying technology in the form of radio waves or microwaves 692 (shown in FIG. 28) such as microwave electromagnetic radiation to evaporate the entrapped water 16 and create the fine mist 40, humidified air or water vapor that can be removed from the drum.

Referring now to FIGS. 1-6, the ultrasonic transducers 10 are electrically operated such that an electrical current 60 provided to the transducers 10 generates a physical movement 62 within the transducers 10 that is in the form of the ultrasonic vibration or ultrasonic resonance 22. The delivery of the electrical power to the various transducers 10 can be through various wired connections or can be in the form of an inductive delivery of electrical current 60 that can be transferred through portions of the appliance 14 and eventually to the various ultrasonic transducers 10.

Figure 3:
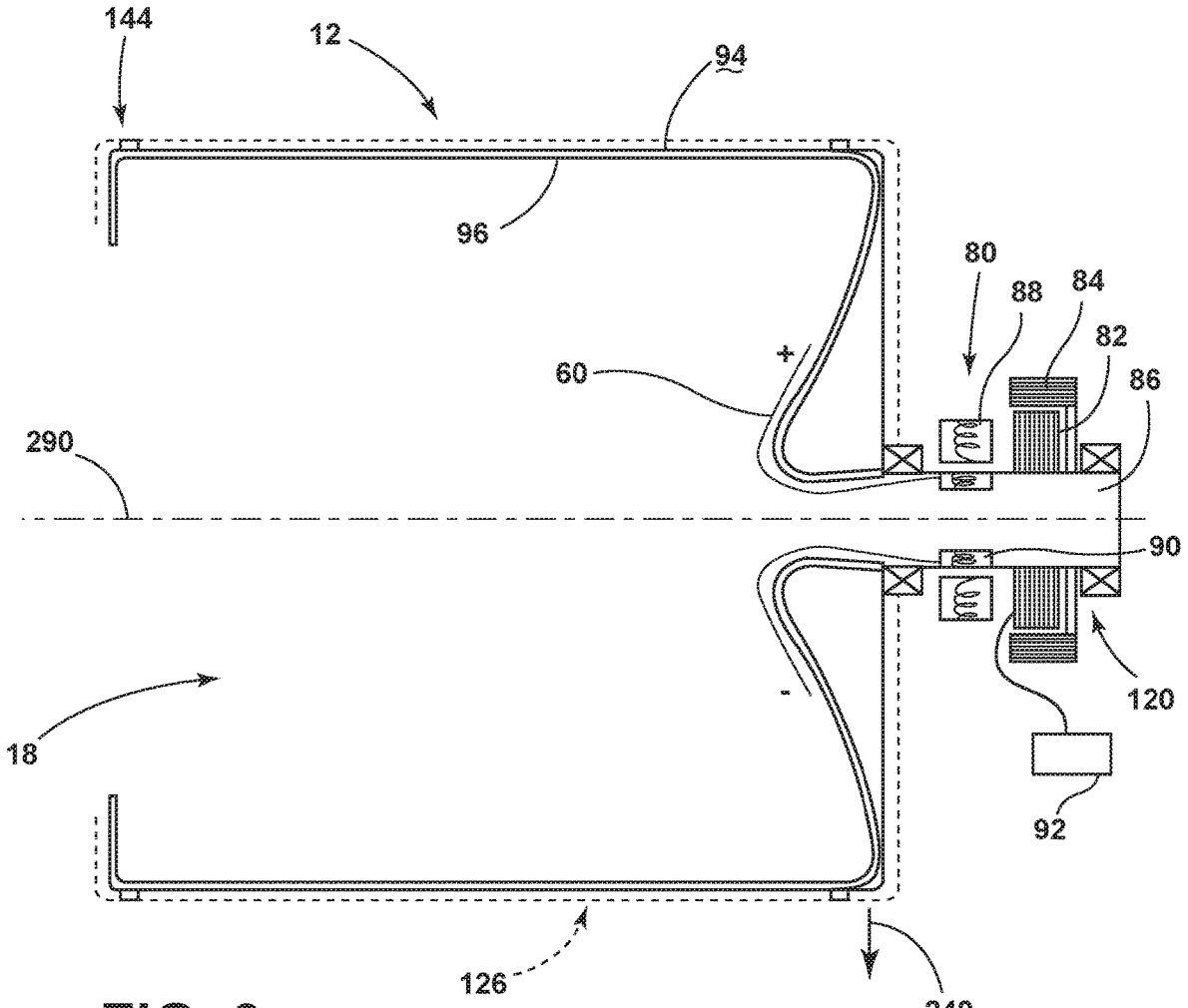
FIG. 3 is a cross-sectional view of the drum having an ultrasonic drying device and illustrating an aspect of the powered delivery system for the ultrasonic drying device.
Figure 4:
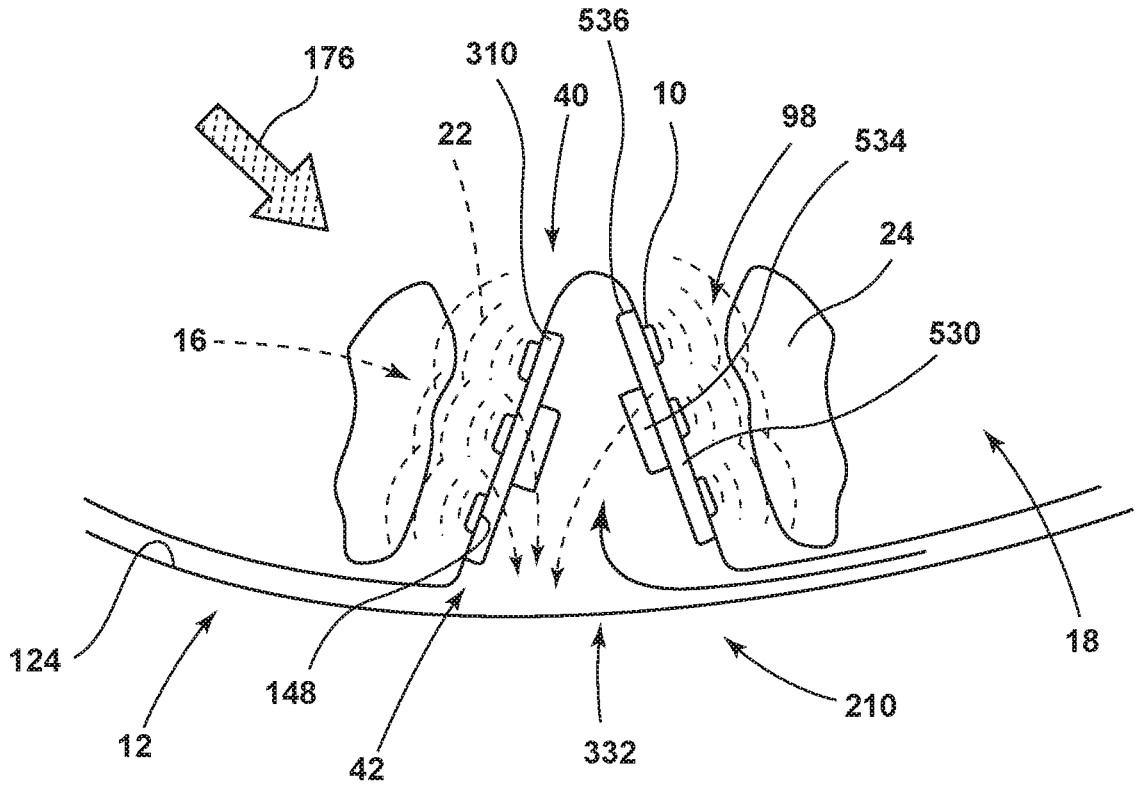
FIG. 4 is a cross-sectional view of a section of a drum incorporating the ultrasonic drying device within a lifter of the drum.

Referring now to FIG. 3, the drum 12 can be rotationally operated through a direct drive motor 80. The direct drive motor 80 includes a stator 82 and rotor 84 that are electromagnetically operated to produce rotational force within a drive shaft 86 for operating the drum 12 in various rotational positions. The direct drive motor 80 can include a secondary stator 88 and secondary rotor 90 combination that are used to produce and/or transmit an electrical current 60 from a power source 92 for the appliance 14 and through the drum 12 so that electrical power can be delivered to the ultrasonic transducers 10 as needed. The use of a direct drive motor 80 and an inductive electrical system allows for rotation of the drum 12 without the need for a hydraulic connection extending between the cabinet 20 and the drum 12. The secondary stator 88 and secondary rotor 90 combination can be used to deliver an electrical current 60 to various portions of the drum 12 where the ultrasonic transducers 10 are located. Accordingly, the electrical current 60 can be delivered from the secondary stator 88 and secondary rotor 90 combination to an outer surface 94 of the drum 12, an inner surface 96 of the drum 12, lifters 98, to a stationary portion 100 of the drum 12, and other various portions of the drum 12 depending upon the configuration of the laundry appliance 14 and the specific mode of operation for rotating the drum 12 within the cabinet 20. Various operational methods for operating the drum 12 will be described more fully herein.

Referring again to FIGS. 1-6, an inductive mechanism 120 for delivering electrical current 60 into the drum 12 from the power source 92 for the appliance 14 can also be disposed proximate a portion of the drum 12. Various electrical contacts 122 can be cooperatively formed between an outer surface 94 of a rotating drum 12 and an interior surface 124 of a substantially stationary tub 126 within which the drum 12 rotates. As the drum 12 rotates within the tub 126, the inductive mechanism 120 can provide for a flow of electrical current 60 into the drum 12. In this manner, the outer tub 126 can act as a form of stator 82 while the drum 12 can act as a type of inner rotor 84 that rotates within the stator 82 of the tub 126 for delivering electrical current 60 into the drum 12 via the tub 126. Various other inductive-type electrical connections can be formed between the rotational drum 12 and various portions of the appliance 14. The use of an inductive mechanism 120 for delivering electrical current 60 to the drum 12 is useful for limiting the use of wires and other "hardwired" physical connections between stationary portions 100 of the appliance 14, such as the cabinet 20 or cabinet structure and the rotational portions of the appliance 14 such as the motor 80 and/or the drum 12 of the appliance 14. The various electrical delivery mechanisms can also be utilized for delivering electrical power for other drying systems, such as RF drying technology that utilizes microwaves 692 (shown in FIG. 28).

Capacitive coupling could also be used to deliver power to the drum 12 as it does not require physical contact with the rotating drum 12. Such capacitive coupling is known in the art and is disclosed in U.S. Pat. Nos. 8,826,561, 8,943,705, and 9,447,537.

Figure 11:
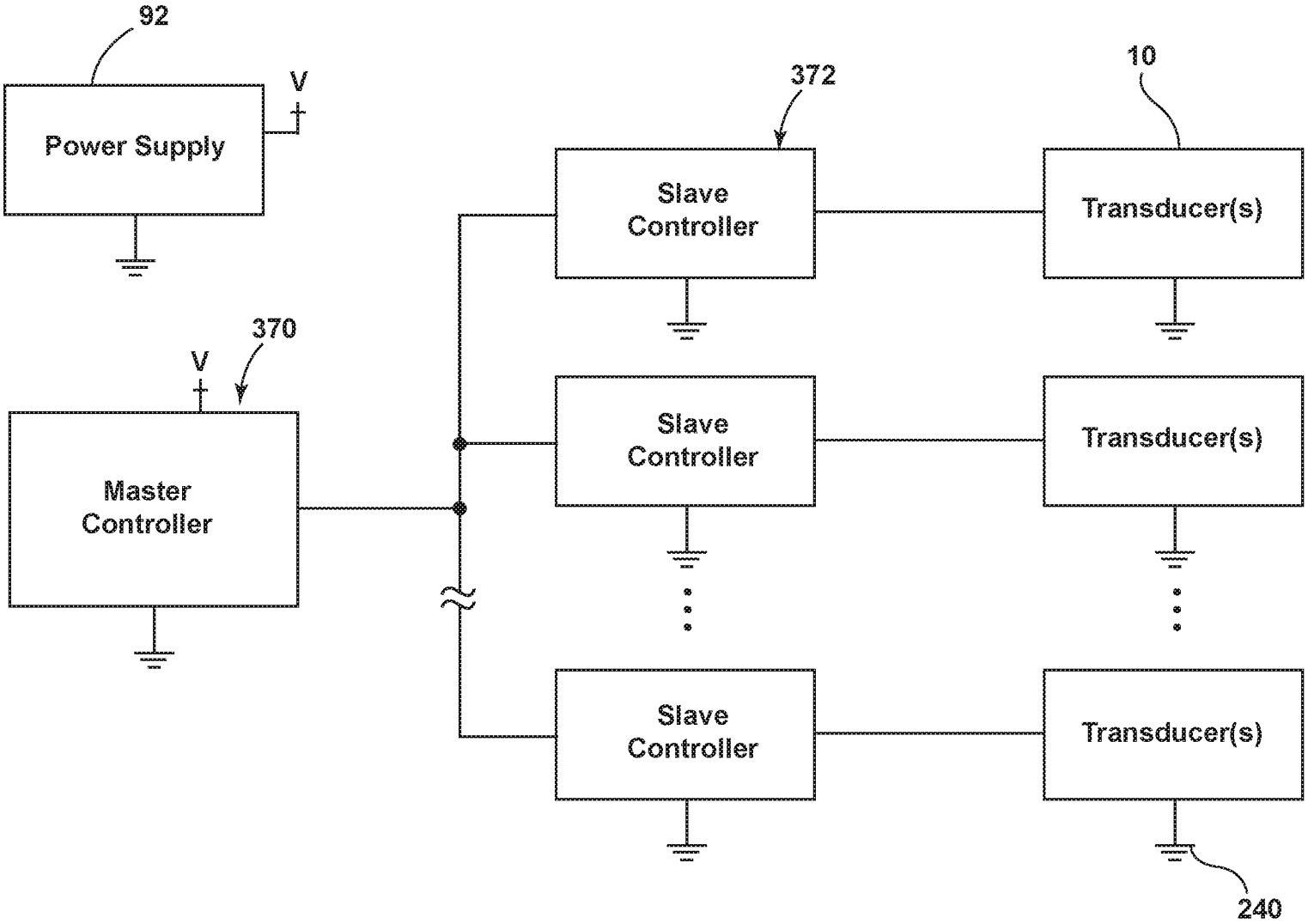
FIGS. 11 and 12 are schematic diagrams illustrating the delivery of electrical current and grounding to the ultrasonic transducers.

FIG. 11 shows a block diagram generally illustrating an example of the circuitry used to drive the outputs of the transducers 10. As described herein, the transducers 10 are driven using a drive signal having a frequency that may correspond to the resonance of the transducer 10. Different frequencies may be used and different transducers 10 may be used with each having a different resonant frequency to produce a plurality of operational frequencies. In addition, different groups of transducers 10 may be driven independent of other groups of transducers 10 to selectively adjust the ultrasonic resonance 22. To allow different groups of transducers to be driven independent of each other, a slave controller 372 may be provided for each group of transducers 10 that may be selectively activated and independently driven. The slave controllers 372 may be provided on the drum 12 with the transducers 10 so as to rotate with the drum 12. In this configuration, each slave controller 372 may be hardwired to the transducers 10 that it controls and may thus provide the drive signal to the connected transducers 10. The drive signal may be generated by the slave controllers 372 or may be generated by the master controller 370 and provided through the slave controllers 372. One benefit of generating the drive signal in the slave controllers 372 is that one would only need to provide power and a ground connection to the rotating drum 12 and slave controllers 372. Another alternative would be to provide a single oscillator disposed on the drum that supplies the oscillating signal to the slave controllers 372 and/or transducers 10. The use of a single oscillator may be practical if the transducers 10 are driven at a common frequency or multiple thereof (the slave controllers 372 could have a frequency divider circuit).

Figure 12:
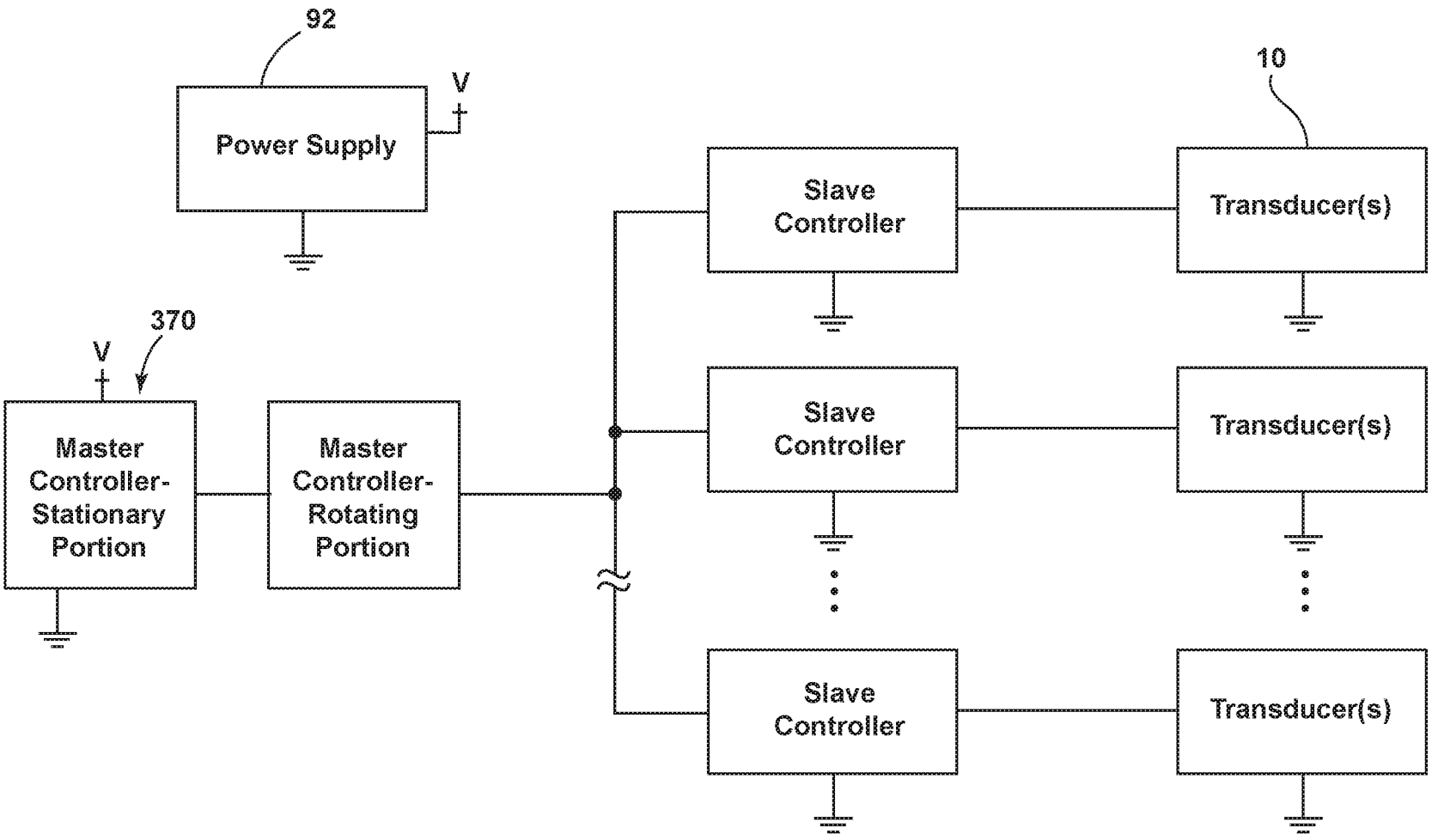
Figure 13:
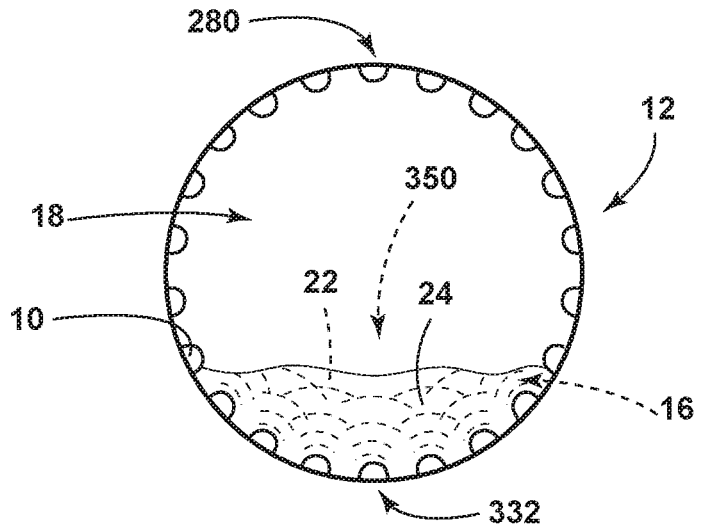
FIGS. 13-15 are schematic diagrams illustrating a satellizing operation of the laundry drum.
Figure 14:
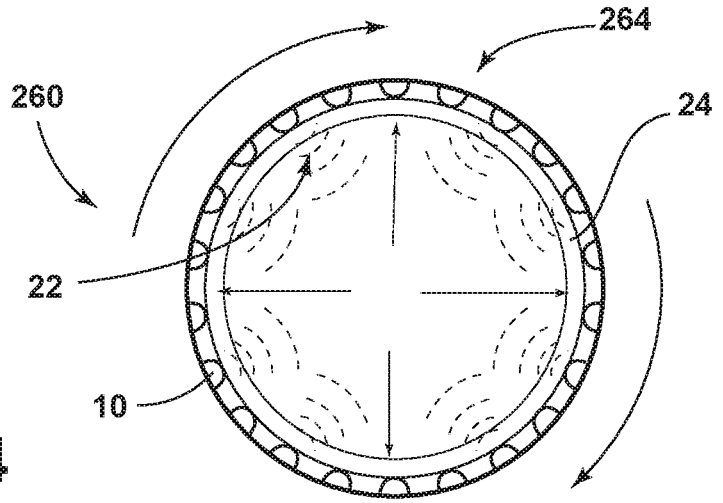
Figure 15:
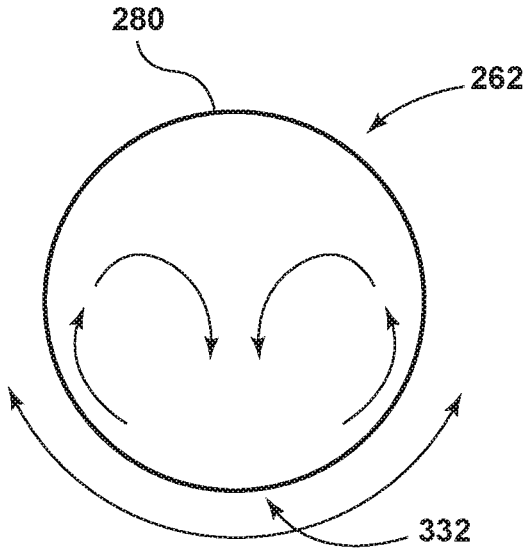
Figure 16:
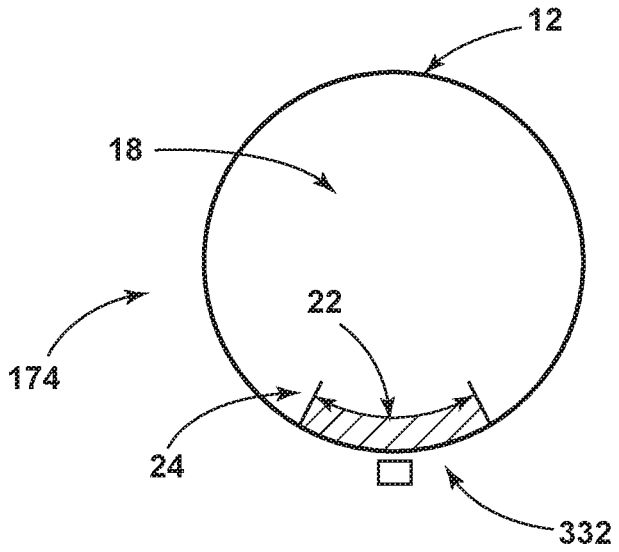
FIG. 16 is a cross-sectional view of the laundry drum illustrating a home position of the drum.

The master controller 370 may control the slave controllers 372 so as to enable or disable select slave controllers 372 from supplying the drive signal to the transducers 10. The communication link between the slave controllers 372 and the transducers 10 may be provided wirelessly, such as by an infrared communication link that allows communication from a stationary location to a location on the moving drum 12. Alternatively, a communication link can be established by modulating the power provided to the slave controllers 372 via the inductive mechanism 120. The slave controllers 372 may be independently addressable or addressable in groups. The master controller 370 may be disposed in a stationary location of the appliance 14 or may be located on the rotating drum 12. The master controller 370 may also be split into separate portions as shown in FIG. 12 such that one portion is disposed in a stationary location and the other portion is located on the rotating drum 12.

As described herein, power may be supplied to the drum 12 intermittently through spaced electrical contacts 122 on the outside of the drum 12. Each such electrical contact 122 may be associated with one or more of the slave controllers 372 so as to energize only those slave controllers 372 connected to the particular electrical contact 122 that is currently connected to the power source 92 and/or master controller 370. For example, if the spaced electrical contacts 122 on the outside of the drum 12 only are connected to the power supply or power source 92 and/or master controller 370 when they are at the bottom of the rotation cycle, only those slave controllers 372 whose associated transducers 10 are strategically located relative to the clothing load 24 are activated while the transducers 10 located at the top of the drum 12 relative to the clothes may not be activated. Also, a pair of contacts 122 may be provided on the drum 12 with one of the contacts 122 corresponding to slave controllers 372 that drive transducers 10 at a first frequency and the other contact 122 corresponding to slave controllers 372 that drive transducers 10 at a second frequency. Electrical contact with each contact 122 of the pair of contacts 122 may be selectively made to enable the transducers 10 at the selected frequency or at both frequencies.

Although slave controllers 372 are shown, it is possible that the slave controllers 372 are not used, and the master controller 370 is more directly responsible for causing the transducers 10 to be driven.

Referring again to FIGS. 1-5, electrical current 60 can also be delivered to the drum 12 via a hardwired connection that can extend from a power source 92 of the appliance 14 and into the drum 12. These hardwired connections can typically include a slidable or otherwise operable electrical connection that exists between the drum 12 and a guide 144 or frame within which the drum 12 rotates. These operable electrical connections can be in the form of a slip ring, bearing ring, or other similar interface where the drum 12 slidably operates relative to an outer stationary component of the electrical connection. The slidable electrical connection serves to maintain electrical contact 122 between the guide 144 and the drum 12 so that electricity can be continuously delivered into the drum 12 from the power source 92 for the appliance 14. Where a slip ring is used, one or more brushes, being flexible in nature, are biased against an outer surface 94 of the drum 12 as an electrode 148 for the drum 12. As the drum 12 rotates, the brushes of the slip ring maintain engagement with the electrode 148 of the drum 12 with the continuous delivery of electricity therethrough. In a bearing ring, a pair of electrodes 148 within the guide 144 and the drum 12, respectively, slidably rotate relative to one another and include one or more conductive bearings disposed therein. The conductive bearing allows for the delivery of electricity therethrough so that electrical current 60 can be delivered from the power source 92 for the appliance 14, through the bearing ring, and into the drum 12 for delivery of electricity to the ultrasonic transducers 10. These techniques for electrical connection to the drum 12 may also be used in other appliances 14, such as within an RF dryer.

Referring again to FIGS. 1-5, 9(*a*)-9(*c*), 13-18 and 24, the ultrasonic transducers 10 can be activated in specific operational modes of the appliance 14. In this specific operational mode, the drum 12 may be rotated according to an oscillating partial rotation phase 170 (exemplified in FIG. 9(*b*) within a specific rotational limit, such that the drum 12 oscillates in clockwise and counterclockwise directions and within a specific rotational distance 172. By way of example, and not limitation, the rotational distances 172 within which the drum 12 rotates in this operational mode can be approximately 720°—or one full rotation in the clockwise direction and one full rotation in the counterclockwise direction. This configuration can result in two full rotations of the drum 12 in a counterclockwise direction followed by two full rotations of the drum 12 in the clockwise direction. This partial rotation phase 170 of the drum 12 can be used as a mechanism for redistributing the load 24 or otherwise changing the orientation of the clothing or other fabric within the drum 12 as a type of mixing operation to change the respective locations of the fabric within the drum 12. Accordingly, the drum 12 is rotated to change which portions of the load 24 engage the ultrasonic transducers 10 during the partial rotation phase 170 of the drum 12.

Figure 9:
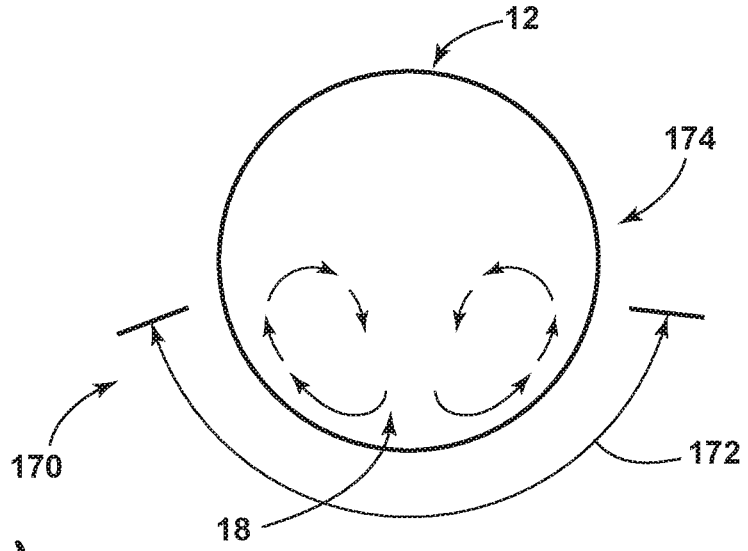
FIGS. 9(*a*) through 9(*c*) are schematic diagrams illustrating a plurality of rotation phases of the drum having the ultrasonic transducers.
Figure 9:
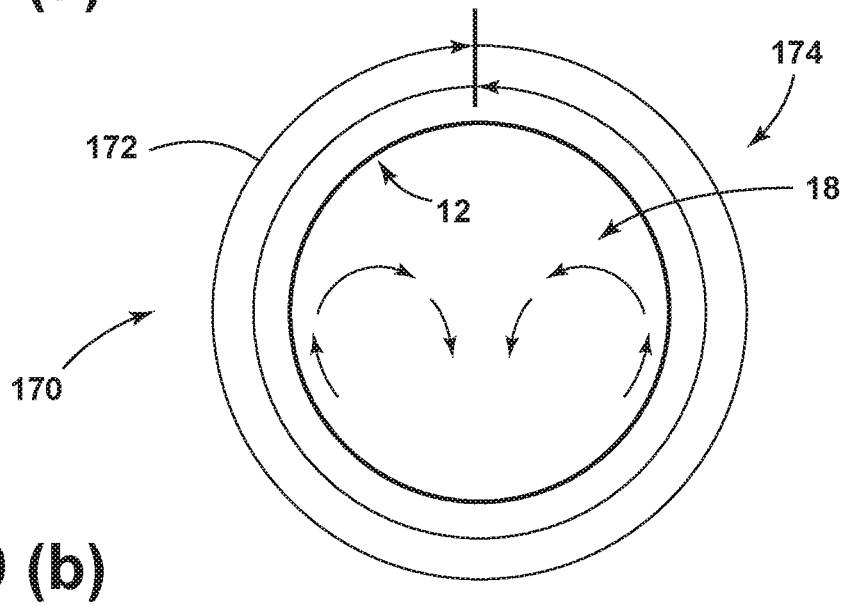
Figure 9:
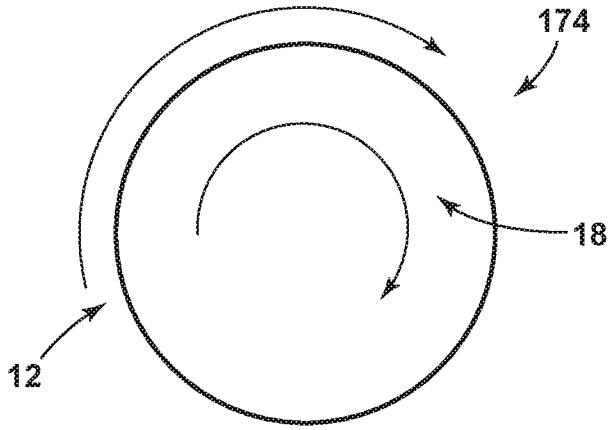

The partial rotation phase 170 of the drum 12 can also be in the form of an oscillation of less than 360° in opposing directions (exemplified in FIG. 9(*a*)). In the various forms of the partial rotation phase 170 of the drum 12, the connection between the drum 12 and the guide 144 for defining the rotation of the drum 12 can be selectively engaged and disengaged during the performance of the partial rotational phase of the drum 12. In such an embodiment, the laundry appliance 14 can include a standard or conventional mode where the drum 12 continuously rotates fully during a particular drying operation 174. This conventional drying mode typically uses a stream of process air 176 that is moved through the drum 12 where the process air 176 can be heated to collect moisture from the laundry. When the mode of the laundry appliance 14 is changed to perform the partial rotational phase of the appliance 14, the hardwired connection can be selectively engaged and the rotation of the drum 12 can be limited to the partial rotation described above. During this partial rotation phase 170, the ultrasonic transducers 10 can be activated to perform the various drying operations 174 for manipulating the entrapped water 16 within the load 24 of laundry to form a fine mist 40 that can be conveniently removed from the drum 12. During the partial rotation phase 170 of the laundry appliance 14, the hardwired connection can be in the form of a flexible wire harness 178 that can be bent and otherwise manipulated to accommodate the partial rotation of the drum 12 for approximately two full rotations of the drum 12. Smaller rotations of the drum 12 can also be accommodated such as a one-third rotation of the drum 12 in either direction, a one-half rotation of the drum 12 in either direction, and other similar rotations of rotational distances 172 defined therebetween. Continuous rotational modes of operation are also utilized within the appliance 14.

In embodiments of the device where the electrical connection is selectively engaged and disengaged during operation of the partial rotation phase 170, an electrode 148 can be selectively attached to the drum 12 and can include a flexible member that follows the rotation of the drum 12 through the partial rotation phase 170. When the partial rotation phase 170 is complete, the electrical connection can disengage, such that a conventional operational mode of the appliance 14 can be once again performed.

Referring again to FIGS. 1-5, where the slip ring or bearing ring is used as the hardwired connection between the drum 12 and drum guide 144, the slip ring or bearing ring can include, as an example, a four-wire interface between the drum 12 and the guide 144 or other portion of the dryer structure. These four-wire interfaces can consist of a powerline of between 0-120 volts, a return line, a low voltage digital transmission line, and a digital reference line that is transmitted around the exterior of the drum 12. Additional wire interfaces may also be included in the electrical connection. In such an embodiment, the powerline can be segmented into various arc segments 190 that extend around the drum 12 and define the drum 12 into various partial rotation segments. The arc segment 190 can be as little as two arc segments 190 that are separated into separate hemispheres of the drum 12 and can be up to six separate arc segments 190 that define six separate rotationally operable portions 510 of the drum 12. By segmenting the powerline, each arc segment 190 can be separated such that connection between an electrode 148 or electrical contact 122 within the guide 144 can transfer electrical power to only a portion of the arc segments 190 during rotation of the drum 12. This may be useful where only a portion of the ultrasonic transducers 10 are needed to be activated at any one time. Accordingly, where six separate arc segments 190 are used within the powerline, only one of the six portions of the power line may be electrically active at any one time. The other five can remain idle such that the transducers within the other five arc segments 190 may not be activated. In various aspects of the device, the electrical contact 122 can span or straddle two separate arc segments 190 at various intervals so that up to two or more arc segments 190 can be electrically active as the drum 12 rotates within the guide 144 for the drum 12. Where two or more arc segments 190 are electrically active at one time, the electrode 148 for delivering the electrical current 60 to the drum 12 has a perimetrical width that can activate two or possibly three arc segments 190 at any one time as the drum 12 rotates within the drum guide 144. The electrical contact 122 can be in the form of brushes or bearings that are positioned a certain arcuate distance from one another within the drum guide 144. The electrical contact 122 may also be inductive or some other form of wireless electrical contact. Accordingly, as the drum 12 rotates relative to the sets of electrical contacts 122, the electrical contact 122 may engage a single arc segment 190. As that arc segment 190 rotates, a junction between two adjacent arc segments 190 may straddle between the sets of electrical contacts 122, such that electricity is delivered to two separate arc segments 190 at a time. The use of such arc segments 190 may also be used to serve as an electrode 148 in an RF dryer.

Referring again to FIGS. 1-5, the electrical contacts 122 for the appliance 14 can be included within lifters 98 that are attached to the drum 12. As will be described more fully below, the lifters 98 can include a self-contained ultrasonic drying module 210 that can be attached to the drum 12. The ultrasonic drying module 210 within the lifters 98 can contain various electrical contacts 122, ultrasonic transducers 10, electrodes 148, data delivery systems, control panels, and other hardware and software for operating the ultrasonic transducers 10 during operation of the appliance 14. These ultrasonic modules within the lifters 98 can be attached to the drum 12 and can define various electrical contacts 122 within the backside of the lifter 98 that may at least partially protrude through the drum 12 for engaging electrical contact 122 within the drum guide 144 or other portion of the dryer structure.

Referring again to FIGS. 1-5, in addition to transferring of electrical power from the power source 92 for the appliance 14 into the drum 12, the various electrical connections, inductive, hardwire, or other similar electrical connection, can be used for data transfer from the drum 12 and to the various control systems of the appliance 14. In an inductive system of power transfer between the power source 92 for the appliance 14 and the drum 12, data transfer can also be performed inductively. In such an embodiment, pairs of inductive rings 220 can be positioned between the drum 12 and an area around the drum 12. A first set of the inductive rings 220 are suspended around the drum 12, and are typically engaged to the drum guide 144 or other portion of the appliance structure. A second portion of the inductive rings 220 are placed concentrically on the surface of the drum 12 itself. A portion of the inductive rings 220 can be devoted to transferring electrical power through the engagement of the pairs of inductive rings 220 for delivering electrical current 60 to the ultrasonic transducers 10 within the drum 12. The inductive rings 220 can also include a data transfer mechanism wherein data communications can be transferred from the drum 12 to the control for the appliance 14 and vice versa. This data transfer can be through the engagement between at least one set of inductive rings 220. In the various hardware connections described above, these connections may be encased in plastic or at least surrounded in plastic to avoid short circuit from moisture infiltration. The use of a plastic covering can also include a low friction guide surface within which the drum 12 can rotate relative to the appliance structure. The inductive rings 220 can also be used to provide electrical connection to one or more electrodes on an RF dryer.

Referring again to FIGS. 1-5, where a hard-wired connection is used, at least one of the wires in the hard-wired connection can be devoted to data transfer from the drum 12 to the control of the appliance 14 and vice versa.

In various aspects of the device, data can be transferred optically via an infrared, light emitting diode (LED) or other optical signaling device. In such an embodiment, data can be transferred from a portion of the drum 12 to a receiver positioned adjacent to the drum 12, such as on the dryer structure. This wireless communication can also be accomplished via radio frequency identification (RFID), lasers, near-field communication, or other similar wireless mechanism that can deliver data from one area of the appliance 14 to another, without impeding rotation of the drum 12 relative to the structure of the appliance 14.

According to various aspects of the device, the ultrasonic transducers 10 can be positioned within at least one stationary portion 100 of the drum 12. These stationary portions 100 can be in the form of a front end or rear end of the drum 12 where a central area of the drum 12 rotates relative to the front and rear ends for manipulating the load 24 of laundry therein. A stationary portion 100 of the drum 12 can also be in the form of a single stationary cylindrical section of the drum 12 where one or more cylindrical sections of the drum 12 rotate relative to the stationary cylindrical section. The transducers 10 can be disposed within a stationary portion 100 of the drum 12 and a stationary wired connection can be attached thereto for delivering electrical power to the ultrasonic transducers 10 and also providing for two-way communication between the ultrasonic transducers 10 and a control for the appliance 14.

In an inductive mechanism 120 for transferring electrical power, as exemplified in FIGS. 1-5, 11 and 12, various magnetic fields defined around the drum 12 can be used in cooperation with various ferromagnetic surfaces positioned around the outer surface 94 of the drum 12 to generate electrical currents 60 within the drum 12 for transferring electrical power to the ultrasonic transducers 10. The ferromagnetic portions 230 of the drum 12 can be rotated relative to the inductive generators 232 positioned around the drum 12. In this manner, various arced segments of the drum 12 can be activated and deactivated selectively during operation of the drum 12. As the ferromagnetic portion 230 of the drum 12 moves past the inductive generator 232, that portion of the drum 12 may be deactivated until such time as it moves within the electromagnetic field generated by the electromagnetic inductive generator 232, positioned around the drum 12.

Referring again to FIGS. 1-5, 11, and 12, various ground connections can be incorporated within the drum 12 and the appliance structure for grounding the electrical system for the appliance 14. In various aspects of the device, a ground path 240 can be adapted to rotate with the drum 12 such that regardless of the rotation or orientation of the drum 12, a ground connection is consistently obtained within the electrical system of the appliance 14 for preventing short circuit occurrences during operation of the appliance 14. The ground path 240 for the drum 12 can also extend into or through a drive shaft 86 for the appliance 14 to ultimately gauge the electrical ground system for the appliance 14.

The drum 12 may be predominantly electrically conductive so as to serve as a common ground for the transducers 10 and slave controllers 372 on the drum 12. In this case, the path for the driver signals to be supplied to the transducers 10 would need to be isolated from the electrically conductive portions of the drum 12. Alternatively, the drum 12 may be predominately made of an electrically insulating material so that electrically conductive circuit tracings may be provided on the drum 12 for electrical connection of the transducers 10 and slave controllers 372. The manner of connecting the ground path 240 on the drum 12 to the stationary portion 100 of the appliance may be similar to the manner in which the power and/or drive signal are connected. If the drum 12 is predominantly electrically conductive, the ground path 48 may be through the drive shaft 86 as mentioned above, or through bearings.

According to various aspects of the device, the operation of the ultrasonic transducers 10 can be used during a hybrid drying operation 174 that includes both conventional aspects and partial rotation phases 170. As discussed above, the ultrasonic transducers 10 may typically be activated during this partial rotation phase 170. In such an embodiment, a conventional operation of the laundry appliance 14 can be performed when the drum 12 is rotated in single or multiple directions and process air 176 is moved through the drum 12. Interspersed with these conventional phases, a partial rotation phase 170 can be incorporated where the ultrasonic transducers 10 are activated during a partial rotation of the drum 12 where a particular load 24 of laundry is maintained in substantially continuous contact with the ultrasonic transducers 10. After the partial rotation phase 170, another conventional drying phase can be activated to tumble, redistribute, mix, or otherwise intersperse the load 24 of laundry so that a different portion of the laundry may be positioned against or near the ultrasonic transducers 10 during performance of a subsequent partial rotation phase 170 of the drying operation 174. These interspersed full-rotation and partial rotation phases 170 can be alternated throughout the performance of the drying operations 174 until the load 24 of laundry is sufficiently dried. The use of ultrasonic drying is typically free of heat such that little if any shrinkage of clothing occurs during these portions of the drying operation 174 where the ultrasonic transducers 10 are in use.

In various aspects of the hybrid drying operation 174, as exemplified in FIGS. 1-16, the ultrasonic transducers 10 may be operated during a high-speed phase 260 of the drum 12. In such an embodiment, clothes can be rotated within the drum 12 at a relatively high speed, such that the clothes satellize against the inner surface 96 of the drum 12. While the clothes are satellized against the inner surface 96 of the drum 12, the ultrasonic transducers 10 can be activated while the clothes are biased outward by application of centrifugal force caused by the rotation of the drum 12. This satellizing of the fabric within the load 24 of laundry can be intermittent. Accordingly, once the clothes load 24 is satellized against the inner surface 96 of the drum 12, the entrapped moisture within portions of the load 24 near the ultrasonic transducers 10 can be removed by operation of the ultrasonic transducers 10. The drum speed can then be reduced to allow the load 24 of laundry to fall away from the inner surface 96 of the drum 12. In this manner, the load 24 of laundry can be redistributed during a tumbling operation 262. This redistribution can be accomplished, in part, by a partial rotation phase 170 of the drum 12. The rotational distance 172 that the drum 12 is partially rotated may be similar to those distances described above. Slower full rotations may also be used for tumbling the load 24. Once the load 24 of laundry is redistributed, the speed of the drum 12 can again be increased so that the load 24 of laundry is satellized against the inner surface 96 of the drum 12 during a high-speed phase 260.

During this satellizing process 264 (shown in FIG. 14), moisture is also acted upon by the centrifugal force and is pushed outward so that entrapped moisture within the load 24 of laundry is moved outward and toward the ultrasonic transducers 10. Additionally, during operation of the ultrasonic transducers 10, entrapped moisture is typically turned into a fine mist 40 that can be suspended in air. This fine mist 40 can be conveniently removed from the load 24 of fabric. These areas of the load 24 of laundry near the ultrasonic transducers 10 eventually become drier. Entrapped moisture within the load 24 of laundry will tend to spread through the laundry and infiltrate these dryer portions such that additional fluid can be moved outward and toward the ultrasonic transducers 10 and eventually removed from the laundry through operation of the ultrasonic transducers 10.

Referring again to FIGS. 9(*a*)-9(*c*) and 13-15, this alternation of the high-speed phase 260 and either a low-speed rotation or partial rotation for performing the satellizing process 264 and a tumbling operation 262 for redistribution of the load 24 of laundry within the drum 12 can be sequentially performed until the load 24 of laundry is dried to a desired dryness level based upon the selected drying operation 174.

During operation of the increasing and decreasing drum speeds, the alternating levels of drum rotation can be conducted according to a specific pattern. By way of example, and not limitation, the drum 12, in a partial rotation phase 170, can move in an oscillating pattern of a specific angular rotation. For example, the drum 12 may rotate 180° to enable re-distribution of the load 24 of laundry. This redistribution may expose more fabric surface area to the ultrasonic transducers 10 as compared to regular tumbling. Regular tumbling may result in certain clothing continually being rotated within an outer region of the load 24 of laundry while other clothing within the middle of the load 24 of laundry may remain within the middle of the load 24 of laundry. By oscillating the drum 12 within a predefined rotational distance, clothing within the center of the load 24 of laundry can be redistributed to outer portions of the laundry and vice versa. Greater degrees of rotation may result in differing degrees of agitation or redistribution of the load 24 of laundry within the drum 12. Certain movements of the drum 12 may also result in a "figure eight" condition. This can be achieved when rotation of the drum 12 in one direction results in the clothing being positioned beyond an angle of repose for the laundry, such that the laundry tumbles downward. Once this angle of repose is surpassed and the laundry starts to tumble, the drum 12 can be moved in the opposing direction to achieve a position beyond the angle of repose for the laundry in the opposing direction. Accordingly, laundry can be moved to tumble in opposing directions during an oscillating rotation of the drum 12. Again, these partial rotations or slower rotations can be interspersed between sattellized high-speed phases 260 of the drum 12 to alternate drying and tumbling operations 262 of the drying operation 174. During the redistribution phases of the drying operation 174, ultrasonic transducers 10 within upper portions 280 of the drum 12 that may not engage the laundry can be deactivated or partially de-energized during its redistribution phase of the drying operation 174.

According to various aspects of the device, the drum 12 can be moved during a redistribution phase of a drying operation 174 in movements other than an axial rotation. Such movements can be in the form of eccentric movements where the rotational axis 290 of the drum 12 in the form of a drive shaft 86 for the drum 12 is moved laterally in a direction perpendicular to the rotational axis 290 of the drum 12. This can result in an eccentric movement of the drum 12 during the tumbling operation 262 that can manipulate the laundry as necessary to evenly redistribute the laundry during each redistribution phase of the drying operation 174.

Referring again to FIGS. 1-7, the ultrasonic transducers 10 typically operate in such a high frequency that the transducers may be damaged where they are not acting upon a medium, such as entrapped water 16 within a load 24 of laundry. Accordingly, the ultrasonic transducers 10 can include various sensing mechanisms that provide for activation of the ultrasonic transducers 10 only in appropriate conditions. Such appropriate conditions are typically where the ultrasonic transducers 10 are in direct contact with laundry and/or moisture within the drum 12 of the appliance 14. This direct contact can be achieved through manipulation of the load 24 of laundry and/or through manipulation of the positioning of the ultrasonic transducers 10 within the drum 12. Additionally, the use of sensors 310 placed either within or near one or more ultrasonic transducers 10 can cooperate with the ultrasonic transducers 10 to sense when the appropriate condition is present for activation of the ultrasonic transducers 10.

Figure 5:
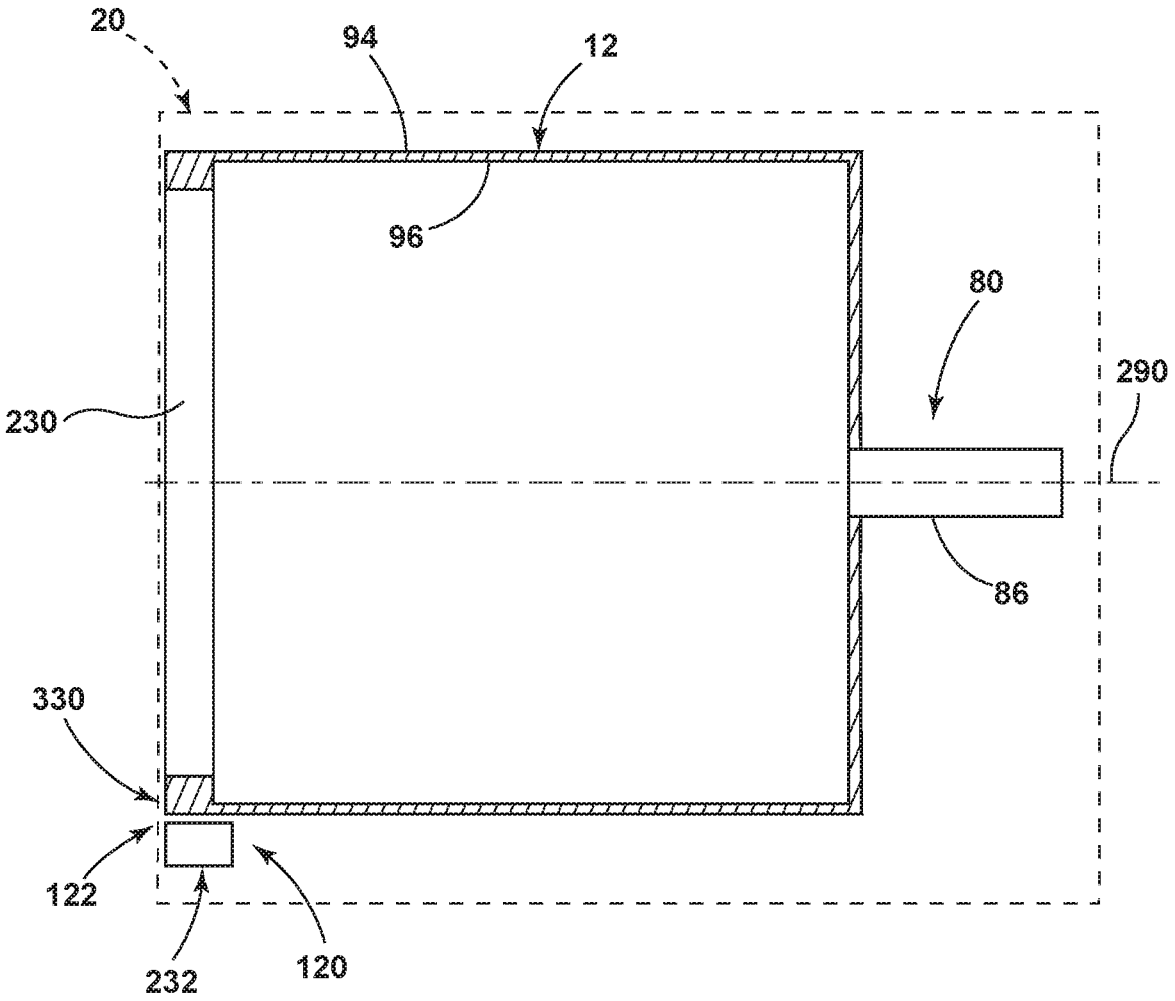
FIG. 5 is a cross-sectional view of the drum showing engagement of a contact switch for activating the ultrasonic drying device.

Referring now to FIG. 5, an optical coder, cam or switching-type arrangement 330 can be positioned within a portion of the drum 12. The switching-type arrangement 330 can include a pair of electrodes 148 or positioning sensors 310 that are placed on the drum 12 in a stationary portion 100 near the drum 12 to be used as a positioning mechanism. This positioning mechanism can be activated when a particular set of ultrasonic transducers 10 are positioned at or near a lowest portion of the drum 12. During a drying operation 174, laundry typically gravitates to the lowest portion of the drum 12 during rotation of the drum 12. The switch-type arrangement 330 can be activated as the drum 12 operates to maintain activation of at least a portion of the ultrasonic transducers 10 positioned at a lowest portion of the drum 12. As the drum 12 operates, laundry is continually redistributed within the drum 12. Similarly, ultrasonic transducers 10 that are rotated about the rotational axis 290 are continually activated and deactivated as they travel around this rotational axis 290. The lower portion of the drum 12 can define a home position 332, where the ultrasonic transducers 10 in the drum position are typically activated as they pass through this home position 332. Once the ultrasonic transducers 10 move through this home position 332, they can be deactivated or de-energized for the reason that they are not typically engaged with any portion of a load 24 of laundry in these areas outside of the home position 332.

The switch-type arrangement 330 can be in the form of an optical encoder that is engaged as a portion of the drum 12 nears a sensing mechanism. The optical encoder activates as it approaches the home position 332 and deactivates as it leaves this home position 332. The switch-type arrangement 330 can also be in the form of a cam, where the drum 12 includes an undulating surface that passes over an encoder. As various cam portions of the drum pass by the encoder, the cam portions of the drum 12 activate the encoder and, in turn, activate the various ultrasonic transducers 10 within the home position 332 of the drum 12. Other similar switch-type arrangements 330 can be included for activating and deactivating the ultrasonic transducers 10. Such switching-type arrangements 330 can include, but are not limited to, magnets, induction mechanisms, rotational switches, proximity sensors, RFID mechanisms, near-field communications and other similar switching-type arrangements 330. The switching-type arrangement 330 can result in the deactivation of the ultrasonic transducers 10 that are not in the home position 332. The switching-type arrangement 330 may also result in a reduced amount of power or reduced operational frequency of the ultrasonic transducers 10 that are away from the home position 332 of the drum 12. The switching-type arrangement 330 also may be used in an RF dryer.

Referring again to FIGS. 1-10, the ultrasonic transducers 10 can also be operated through operation of various sensors 310, such as moisture sensors and/or contact sensors that can be incorporated within or around ultrasonic transducers 10. In such an embodiment, each transducer 10 or array of transducers 10 can include a moisture sensor or contact sensor that senses when the ultrasonic transducers 10 are in direct contact with moisture. Typically, this moisture will be entrapped water 16 that is contained within the load 24 of laundry. A weight sensor can be incorporated and can serve to activate the ultrasonic transducers 10 when a portion of the load 24 of laundry is placed against the weight sensor. The weight of the laundry can act upon a portion of the ultrasonic transducers 10 to provide an indication that the ultrasonic transducers 10 are directly engaged with a portion of the load 24 of laundry. This direct contact is indicative of a preferred operational condition where activation of the ultrasonic sensors 310 is preferred for manipulating the entrapped water 16 contained within the load 24 of laundry. The moisture sensors and contact sensors can also work in conjunction. In such an embodiment, the contact sensors can indicate when a portion of the load 24 of laundry is engaged with the ultrasonic transducer 10. The moisture sensor, in turn, can provide information about whether entrapped water 16 is contained within the relevant portion of a load 24 of laundry in contact with the ultrasonic transducers 10. The contact sensors and/or moisture sensors can also be used to measure the amount of entrapped water 16 contained within the load 24 of laundry. These measurements can be taken instantaneously or can be accumulated over time to determine an amount of moisture that has been removed and efficiency of the ultrasonic transducers 10, the amount of time remaining in a particular drying operation 174, the type of laundry or fabric being dried, and other similar information that can be conveyed to the user relating to the performance of the drying operation 174.

Referring again to FIGS. 1-10, various ultrasonic transducers 10 can be arranged within the drum 12 to provide varying frequencies of operation 350 during a particular drying operation 174. In such an embodiment, the various ultrasonic transducers 10 within the drum 12 can be modified to produce various ranges of vibration frequencies throughout a particular drying operation 174. These different frequencies may be used to maximize the efficiency of the drying operation 174. It has been discovered that different amounts of moisture within the load 24 of laundry, different types of fabric within the load 24 of laundry, different amounts of laundry within a particular load 24 of laundry, and other load 24 characteristics, can each have an optimal frequency of operation 350 for the ultrasonic transducers 10. Accordingly, the ultrasonic transducers 10 can be modified to produce these various frequencies throughout operation of the drying operation 174 to maximize the removal of moisture from the fabric throughout the course of the drying operation 174. Accordingly, where particularly high-water content load 24 of laundry is included within the drum 12, the ultrasonic transducers 10 may initiate activation of a particular frequency. As the amount of entrapped water 16 is removed from the load 24 of laundry, the frequency of operation 350 for the ultrasonic transducers 10 may change or modulate throughout the course of the drying operation 174 to maximize the removal of moisture during operation of the appliance 14. The modification of operational ranges from each of the ultrasonic transducers 10 can ensure that optimal separation occurs between the entrapped water 16 and the laundry over the widest range of conditions experienced over the life of the appliance 14.

The change in frequencies described herein can be achieved through a blind duty cycle that can be repeated during each drying operation 174. During the course of the drying operation 174, the frequency of the ultrasonic transducers 10 modulates according to a predetermined pattern. Accordingly, regardless of the type of fabric being dried, the amount of moisture included within the laundry and the size of the load 24 of laundry, the optimal frequencies will be achieved intermittently for each condition throughout the course of the drying operation 174.

The range of frequencies can also be determined through various sensors 310, such as humidity sensors, that can sense the amount of mist that is generated through operation of the ultrasonic transducers 10 upon the entrapped moisture within the laundry. Where greater amounts of humidity are detected, that particular frequency of operation 350 corresponding to higher efficiency of the ultrasonic transducers 10 can be continued for a certain amount of time. Where the amount of humidity or moisture within the drum 12 decreases, the ultrasonic transducers 10 can operate through a range of varied frequency modulations to seek out another optimal range or frequency of operation 350 for maximizing operation of the ultrasonic transducers 10. Where no additional optimal range is found, this may be indicative of the end or nearing the end of the drying operation 174 where the ultrasonic transducers 10 may be deactivated or their power diminished during the end phases of the drying operation 174.

The various frequencies of operation 350 for the ultrasonic transducers 10 can be achieved through placement of transducers 10 that operate under a single frequency throughout portions of the drum 12. While each ultrasonic transducer 10 operates under a single frequency, numerous transducers 10 can be included in the drum 12 where each transducer 10 operates at a frequency of operation 350. Accordingly, a range of frequencies of operation 350 of the ultrasonic transducers 10 can be achieved by placement of ultrasonic transducers 10 of a varying but constant frequency that are located throughout the drum 12. During performance of the drying operation 174, various types of ultrasonic transducers 10 that operate at a particular frequency of operation 350 may provide an optimal drying performance. As the drying operation 174 continues, different sets of ultrasonic transducers 10 that operate at a different frequency of operation 350 may, at various times, become the optimal transducers during the drying operation 174.

Through the use of differing frequency of operation 350 within each ultrasonic transducer 10 or differing frequencies of operation 350 amongst the varying ultrasonic transducers 10 and throughout the course of the performance of the drying operation 174, an optimal drying "sweet spot" can be achieved throughout the course of the drying operation 174. This variance of frequencies of operation 350 can serve to maximize the use of the ultrasonic transducers 10 to shorten the length of time that is takes to dry a particular load 24 of laundry.

According to various aspects of the device, the ultrasonic transducers 10 can be placed upon a rotational or operable portion 510 of the drum 12. In such an embodiment, the ultrasonic transducers 10 can be activated and deactivated as needed, such that only the ultrasonic transducers 10 that are in direct contact with the load 24 and/or entrapped water 16 are activated while those that are not in contact with water and/or laundry are deactivated to save energy and also to prevent wear upon the ultrasonic transducers 10. The various ultrasonic transducers 10 can also be located within the lifters 98 of the drum 12. During operation of the drying appliance 14, the lifters 98 serve to push the laundry upward and may provide longer occurrences of direct engagement between the drum 12 and portions of the load 24 of laundry during performance of a particular drying operation 174.

Additionally, the lifters 98 can define an ultrasonic transducer module that can be designed as a substantially complete unit and installed within a drum 12 for the drying appliance 14 in place of a conventional lifter 98. The ultrasonic transducer module, as discussed above, can contain a control unit. This control unit can serve to define the various frequencies of operation 350 of the ultrasonic transducers 10 within a particular lifter 98. Each of the lifters 98 may operate according to a different set of controls that are independently defined within each ultrasonic transducer module. Each ultrasonic transducer module can also contain a set of ultrasonic transducers 10 that each define a consistent but differing frequency among the ultrasonic transducers 10 within that particular ultrasonic transducer module. Accordingly, the ultrasonic transducer module can be included to provide the varying frequencies of operation 350 of the various ultrasonic transducers 10 for the drying appliance 14.

Referring again to FIGS. 1-7, the drying appliance 14 can include a separate transducer control module that is positioned outside of the drum 12 that serves to control operation of the various ultrasonic transducers 10 disposed within the drum 12. The control module can be split into separate control modules for independent operation of various sections of the drum 12 so that various sections of the ultrasonic transducers 10 can be operated to maximize operation for that particular location of the drum 12. In such an embodiment, various ultrasonic submodules can be coupled with one primary control module for operating the ultrasonic transducers 10 as a cohesive unit during performance of a drying operation 174.

Referring again to FIGS. 1-15, in aspects of the device that include a partial rotation phase 170 for the drying operation 174, electrical power can be provided to the drum 12 and data communications can be provided to and from the drum 12 via a length of braided wire or other flexible conductor that can be positioned to absorb limited rotation. The use of the flexible conductor can eliminate the need for a slip ring or bearing ring as the primary electrical interface 396 between the rotational drum 12 and the surrounding structure of the appliance 14. Additionally, a cam or other similar actuator, such as a solenoid, can define intimate contact with an electrode 148 as the drum 12 rotates about the rotational axis 290. Additionally, contact between the cooperating electrodes 148 of the rotating drum 12 and the surrounding structure can define engagement when the drum 12 is stationed. Accordingly, the ultrasonic transducers 10 can define an actuated state when the drum 12 is stationary or substantially stationary with minimal to no rotational operation. In such an embodiment, the ultrasonic transducer 10 can act upon a specific portion of the load 24 of laundry that rests on or near the interior surface 124 of the drum 12. Additionally, in such an embodiment, the ultrasonic transducers 10 can be operable to an extended position 390 inside the drum 12 and into engagement with the load 24 of laundry proximate the home position 332 of the drum 12. When the operation of the ultrasonic transducers 10 becomes less efficient, such that the moisture around the ultrasonic transducers 10 has been largely or completely removed, the ultrasonic transducers 10 can be operable to a retracted position 392 outside of the drum 12. When in the recessed position, the drum 12 can be activated for operation about the rotational axis 290 to continue a conventional tumbling operation 262.

Figure 17:
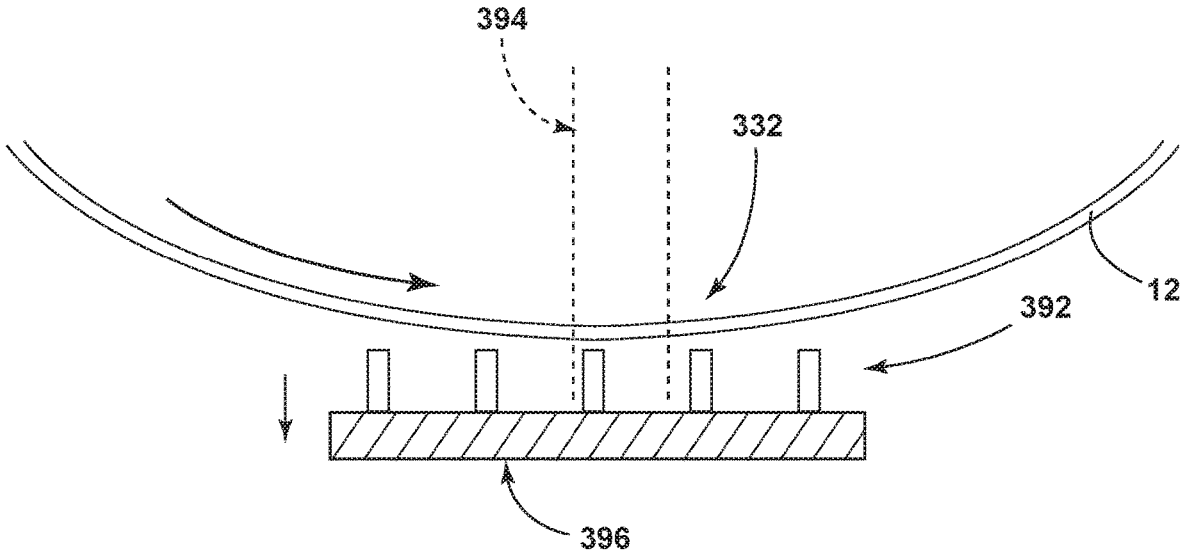
FIGS. 17 and 18 are schematic cross-sectional views of a laundry drum having ultrasonic transducers that are operable between retracted and extended positions.
Figure 18:
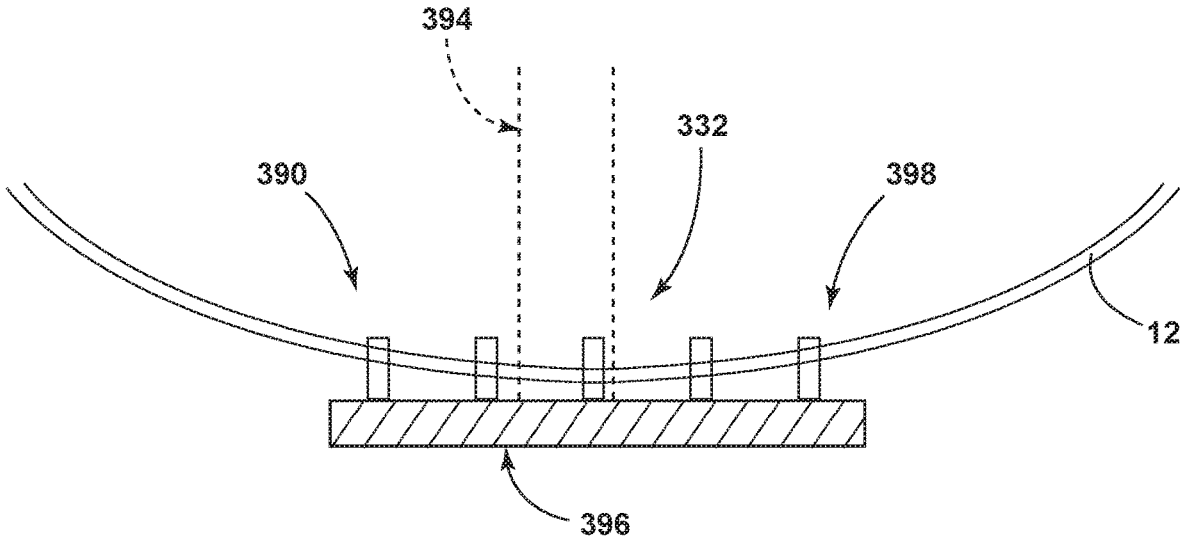

According to various aspects of the device, as exemplified in FIGS. 17 and 18, a drive mechanism that includes a torsion spring 394 can be used as the rotating interface when the drum 12 is driven. Such a drive mechanism can include a helical drive, such that when torque is applied, resistance to rotation from the drum 12 can cause a driver to move the helical drive in a clutching operation to move the transducers 10 out of contact before the drum 12 begins its rotational operation about the axis. Other types of cams or solenoids can also be used to move the ultrasonic transducers 10 between the extended and recessed positions to define the various operation phases of the drum 12 during the performance of the drying operation 174. The transducers 10 can be placed in a fixed position within the interior of the drum 12 or proximate the interior of the drum 12. When the drum 12 comes to a stop, instead of the transducers 10 moving between the extended and retracted position 390, 392, an electrical interface 396 can move between the extended and retracted position 390, 392 to activate those ultrasonic transducers 10 that are in the home position 332 and in engagement with the load 24 of laundry having the entrapped water 16. In such an embodiment, the transducers 10 can also be incorporated within the electrical interface 396 that can detect the presence and the amount of entrapped water 16 within a load 24 of laundry at least within the areas within the ultrasonic transducers 10. Where the electrical interface 396 is the operable member that moves between the extended and retracted positions 390, 392, the ultrasonic transducers 10 can be located throughout the interior surface 124 of the drum 12. That portion of the drum 12 that stops in the home position 332 can receive the electrical interface 396 in the extended position 390. Accordingly, only those ultrasonic transducers 10 that are within the home position 332 will typically be activated upon engagement of the electrical interface 396 with the ultrasonic transducers 10 in the home position 332.

During operation of the helical drive for moving the ultrasonic transducers 10 and/or the electrical interface 396 between the extended position 390 and to the retracted position 392, the helical drive can be rotated until it achieves a stopped position. When the helical drive reaches this stopped position, the retracted position 392 of the electrical interface 396 and/or the ultrasonic transducers 10 is achieved and torque is removed from the motor 80. When torque is removed from the driving device via a pulley, direct drive, sprocket or other similar driving device, the torsion spring 394 can drive the helical cam back to apply a force upon the electrical interface 396 and/or the ultrasonic transducers 10 to be moved back into the extended position 390 into the drum 12. This process can be continually repeated as the drum 12 moves through the various phases of the drying operation 174. In each stopping phase 398, where the ultrasonic transducers 10 within the home position 332 are activated is typically followed by a redistributing tumbling operation 262 or a conventional tumbling phase. After the laundry load 24 is redistributed during the appropriate tumbling operation 262, the drum 12 can then come to a stop such that the clutch-type mechanism can then serve to extend the electrical interface 396 and/or the ultrasonic transducers 10 to the extended position 390 into the drum 12 and into engagement with the laundry having entrapped water 16.

The various clutch-type mechanisms can include, but are not limited to, a helical drive, solenoid, wax motor, fluid piston, combinations thereof, or other similar device that can be used to actuate the ultrasonic transducers 10 and/or the electrical interface 396 into engagement for applying the ultrasonic resonance 22 into the load 24 of laundry and the trapped water therein. The clutch-type mechanism can act as a safety device that requires the movement of the electrical interface 396 and/or the ultrasonic transducers 10 to the retracted position 392 before the drum 12 is allowed to operate in a rotational manner about the rotational axis 290.

Figure 19:
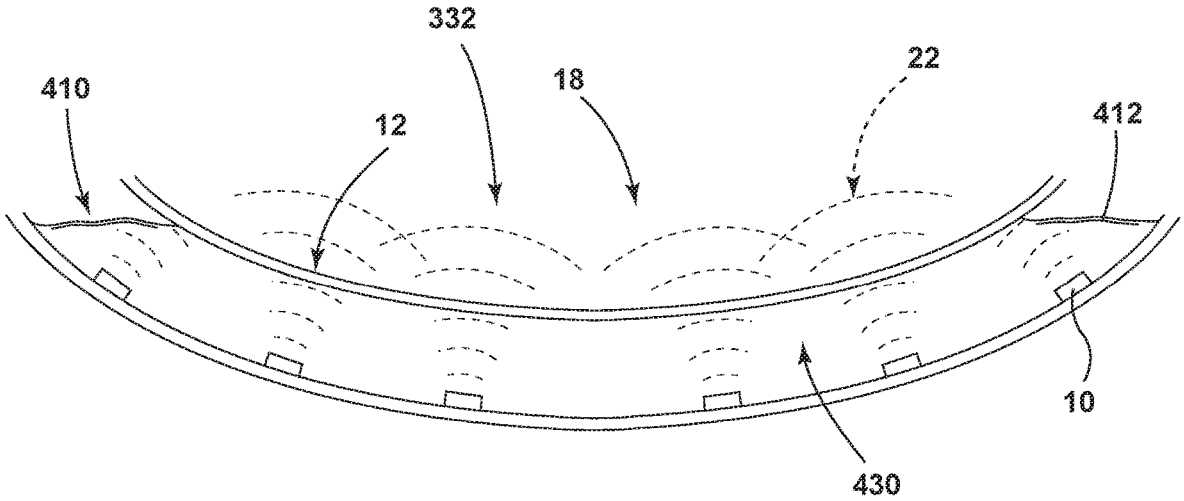
FIGS. 19 and 20 are schematic diagrams illustrating alternative forms of ultrasonic transducers for generating the ultrasonic resonance within the drum.

According to various aspects of the device, as exemplified in FIG. 19, the ultrasonic transducers 10 can be activated through the use of a gap 410 between the drum 12 and the surrounding structure of the drum 12, such as tub 126, that is bridged by viscous fluids 412, oil, grease, gas, combinations thereof, or other similar frequency or vibration conducting material. As the drum 12 rotates, the ultrasonic transducers 10 may remain stationary with the fluid shears to allow relative motion with respect to the drum 12. When the drum 12 is stationary or slow moving, the viscous fluid 412 and/or gas can be used to conduct vibration or the ultrasonic resonance 22 into the drum 12 or conduct vibration into devices that are disposed on the drum 12. The use of such a device may require a sufficiently large surface or transfer area on the drum 12 or within portions of the drum 12. Additionally, separate components can be attached to the drum 12 for receiving the ultrasonic resonance 22 via the viscous fluid 412 and/or vibration transferring in gas. In this particular embodiment, the drum 12 may be surrounded by a separate tub 126 that surrounds the drum 12 and maintains placement of the viscous fluid 412 and/or gas within an interstitial space defined between the outer surface 94 of the drum 12 and interior surface 124 of the tub 126. The viscous fluid 412 and/or gas can also be disposed within the channels that extend around the drum 12 and are contained therein to prevent loss or leakage of this fluid and/or gas during operation of the appliance 14. Where the fluid and/or gas is incorporated in the appliance 14, the ultrasonic transducers 10 can be disposed proximate a structure of the appliance 14. Operation of the ultrasonic transducers 10 can transmit the ultrasonic resonance 22 through the viscous fluid 412 and/or gas that is then transmitted into the interior of the drum 12 for treatment of the laundry and entrapped water 16 contained therein. By transmitting vibration through the bridging media that takes the form of the viscous fluid 412 or gas, the electrical wiring can be provided to a fixed position of the ultrasonic transducers 10 and may not need to be delivered to the drum 12 for operation of the ultrasonic transducers 10.

Figure 20:
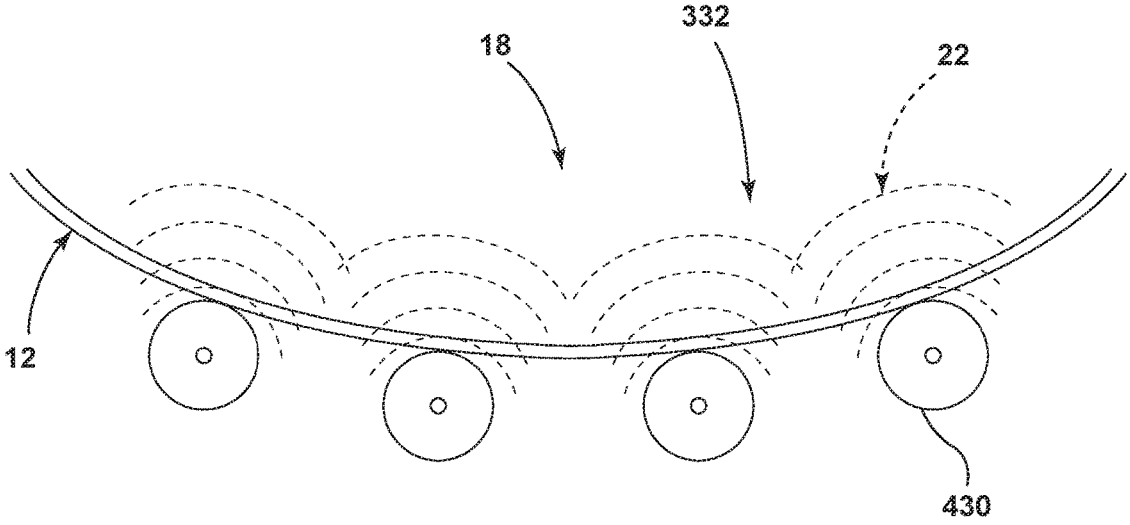

Referring now to FIG. 20, operation of the ultrasonic transducers 10 can also be performed through the use of a rigid roller 430 or other sufficiently rigid bearing system that can be placed in contact with the drum 12. The ultrasonic transducers 10 can be placed in contact with the rigid bearing system, such that the rigid bearing system receives the ultrasonic resonance 22 emitted by the ultrasonic transducers 10. This ultrasonic resonance 22 is then transferred through the rigid bearing system and into the drum 12. The rigid bearing system can include one or more rollers 430 or bearing-type mechanisms that can deliver the ultrasonic resonance 22 to an area, such as the home position 332 of the drum 12 during operation of the particular drying phase. In this embodiment, the ultrasonic transducer 10 can be maintained in a substantially fixed position relative to the rigid bearing system and also relative to the drum 12. Accordingly, electrical wiring and data communications can be delivered to the fixed position of the ultrasonic transducer 10 for activation and deactivation during performance of the various drying phases.

Figure 21:
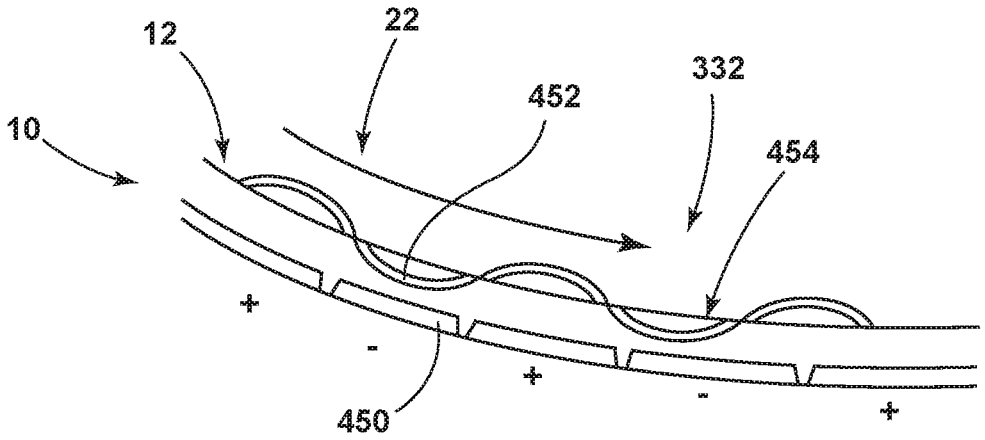
FIGS. 21-23 are schematic diagrams illustrating alternative forms of ultrasonic transducers for generating the ultrasonic resonance within the drum.
Figure 22:
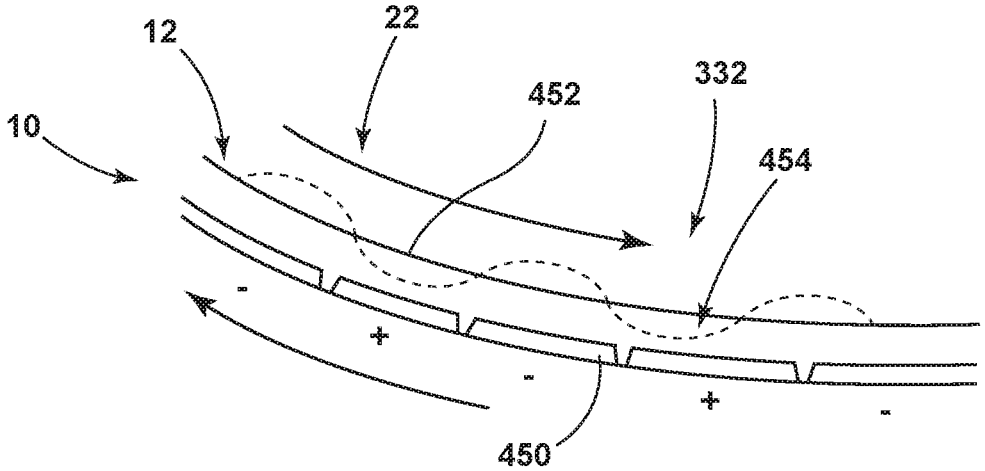

Referring now to FIGS. 21 and 22, the ultrasonic transducers 10 can be in the form of various arrays and/or patterns of permanent high-intensity magnets 450 that are set around the outside of the drum 12. These high-intensity magnets 450 can be set around the outside of the drum 12, in the drum 12, within flexible portions of the drum 12, within lifters 98, combinations thereof, and other various portions of the drum 12. In this embodiment, thin membranes 452 can be located around the circumference of the drum 12 where the membranes 452 interact with the plurality of high-intensity magnets 450 to produce deflection when disposed in the proximity of one or more of the high-intensity magnets 450. The high-intensity magnets 450 can be disposed in a tight array that surrounds the drum 12. When the drum 12 is rotated at a high speed, the flexible membranes 452 of the drum 12 quickly interact with the high-intensity magnets 450 to produce a series of high-speed deflections 454 that result in vibrations that can produce the ultrasonic resonance 22 desired to manipulate the entrapped water 16 into the fine mist 40 that can be removed from the drum 12. The high-intensity magnets 450 can be disposed where lines of opposing polarities are placed next to each other to produce a vibrating inner surface of the rotating drum 12.

As the membranes 452 pass over the high-intensity magnets 450, the membranes 452 are moved in one direction, typically into or away from the drum interior, by positive polarity high-intensity magnets 450. The membranes 452 are subsequently repelled in the opposite direction by an opposing polarity high-intensity magnet 450. The alternation of the polarities of the high-intensity magnets 450 results in the high-speed deflection 454 of the membranes 452. Fast rotation of the drum 12 results in a high-speed deflection 454 of the membranes 452 as the membranes 452 pass by the opposing polarities of the high-intensity magnets 450 that are set around the drum 12. To increase the vibration of the membranes 452, the array of high-intensity magnets 450 can be rotated in an opposing direction to the rotation of the drum 12. Accordingly, the speed of the vibration of the membranes 452 can be increased, where the arrays of high-intensity magnets 450 rotate in one direction and the membranes 452 that are deflected by the high-intensity magnets 450 are rotated in the opposing direction.

The high-intensity magnets 450 can be disposed in linear arrays that extend around one or more portions of the drum 12. Accordingly, the high-intensity magnets 450 can be defined by a single band or multiple bands that can be rotated about the drum 12 or can remain stationary about the drum 12. The frequency of the ultrasonic resonance 22 can be modified through operation of the drum 12 and/or the high-speed magnets at faster or lower speeds to increase or decrease the frequency of deflection of the membranes 452 within the drum 12. In various aspects of the device, the high-intensity magnets 450 can be moved closer to the drum 12 or moved away from the drum 12 to increase or decrease the amount of deflection experienced by the membrane 452 during operation of the drum 12. Additionally, the high-intensity magnets 450 are rotated about the drum 12 or placed about the drum 12, such that the high-intensity magnets 450 are typically closest to the outer surface 94 of the drum 12 in the home position 332 of the drum 12. Accordingly, the greatest deflection experienced by the membranes 452 can be adapted to be within this home position 332 of the drum 12 (exemplified in FIG. 22). The high-intensity magnets 450 may also be positioned only within the home position 332 of the drum 12 where the high-intensity magnets 450 are positioned in a fixed location with respect to the structure of the appliance 14.

Figure 23:
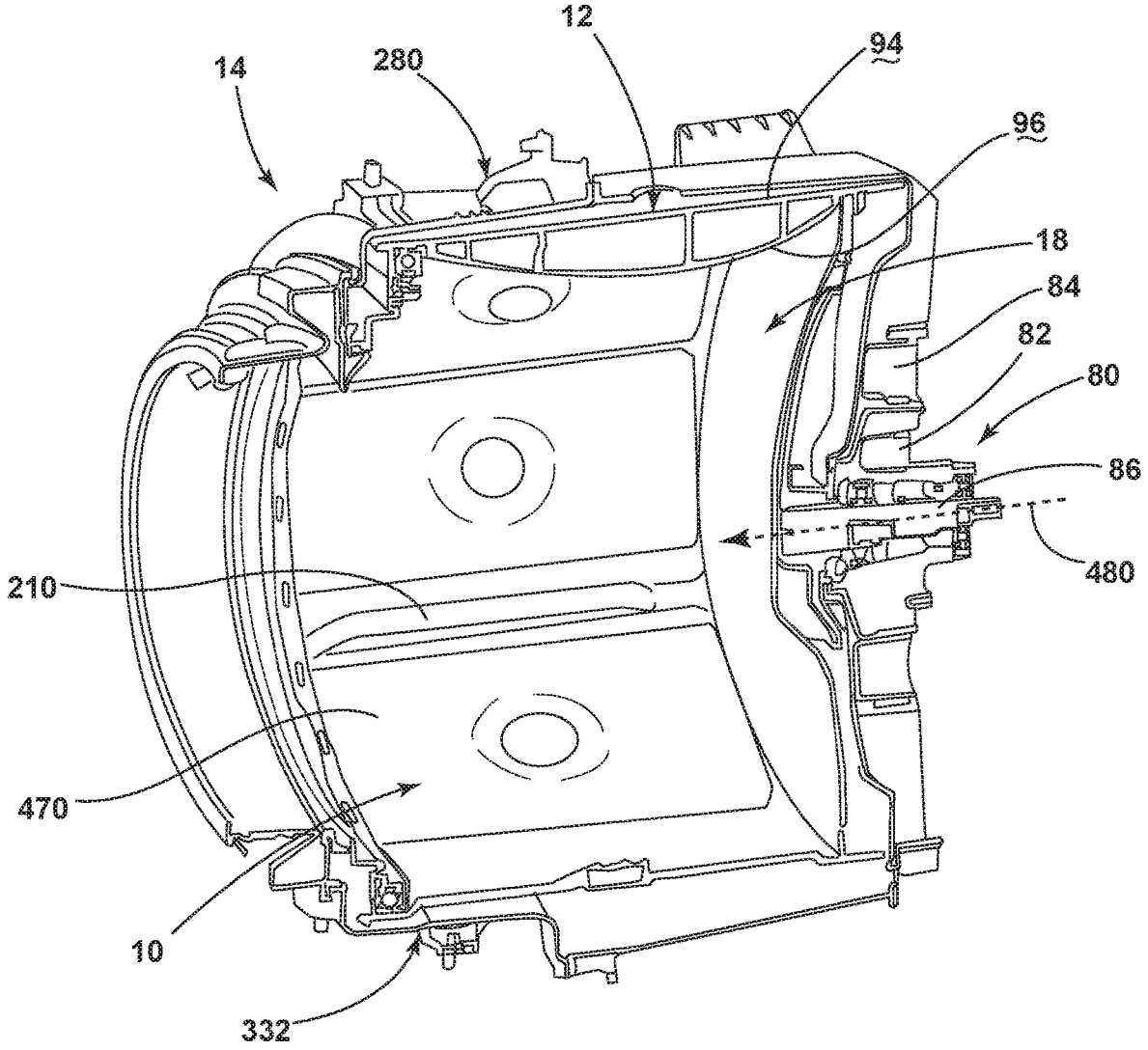

According to various aspects of the device, as exemplified in FIG. 23, the ultrasonic transducer 10 can be disposed within a motor 180 driving the drum 12 about the rotational axis 290. In such an embodiment, the ultrasonic transducer 10 applies rotation to the motor 80 and/or the drive shaft 86, and this ultrasonic resonance 22 is then transmitted into the drum 12 for application of the ultrasonic resonance 22 into the entrapped water 16 within the laundry. According to various aspects of the device, the ultrasonic transducer 10 can be the motor 80. In such an embodiment, the drum 12 can be lined with resonating plates 470 that are tuned to resonate at a modulation frequency. This material will typically have a modulation frequency that is ultrasonic. The various resonating plates 470 that are disposed around the drum 12 may resonate at frequencies that are sub-modulation, at the resonant frequency or are a harmonic of the resonant frequency.

By way of example, and not limitation, if a resonating plate 470 is tuned or manufactured to resonate at a frequency of 1000 Hz, it can be excited at 500 Hz (a sub-frequency), 1000 Hz (the resonant frequency), or 2000 Hz (the harmonic resonant frequency). Additional multiples of this progression would also define harmonics of this resonant frequency. Accordingly, various frequencies can be used to provide a series of sub-modulation, resonant frequencies and harmonics that can be used to transmit the ultrasonic resonance 22 from the tuned resonating plates 470 and into the drum 12 for manipulating the entrapped water 16.

As the laundry bears against the resonating plates 470, the resonating plates 470 vibrate according to the appropriate sub-modulation, resonant frequency or harmonics and the entrapped water 16 is acted upon by the ultrasonic resonance 22 and is turned to the micro-droplets in the form of fine droplets of fluid, typically water, that can be suspended in air and easily removed from the drum 12. As will be discussed more fully below, process air 176 can be directed from the drum 12 so that these fine droplets or mist can be moved to the exterior of the drum 12. For movement of the entrapped water 16 that has been turned into the fine droplets by the ultrasonic resonance 22, the resonating plates 470 may include a series of pores, openings, or other apertures 532 that allow the fine droplets to pass therethrough for removal from the drum 12 and from the appliance 14.

In embodiments using the tuned resonating plates 470, the excitation energy can come from a direct drive motor 80. The direct drive motor 80 drives the drum 12 at a desired rotational speed. This rotational speed may be in the form of a satellizing velocity that uses centrifugal and centripetal forces to satellize the laundry against the inner surface 96 of the drum 12. An ultrasonic frequency 480 can be directed or injected into the main driving frequency. This ultrasonic frequency 480 can be in the form of a sine wave or square wave. The ultrasonic frequency 480 can be of a magnitude that is high enough to cause the plates to resonate and shake the entrapped water 16 into the micro-droplets and define the mist that can be removed from the drum 12. Within the direct drive motor 80, the stator 82 can be rigidly mounted to the structure of the appliance 14. The rotor 84 will rotate relative to the stator 82 to pass energy into the drum 12 via the shaft. The drum 12 can then pass the energy to the resonating plates 470 where the resonating plates 470 can be excited to produce the sub-modulation, resonant frequency or harmonic frequency as desired to produce the misting effect of the entrapped water 16 within the laundry. In such an embodiment, the motor 80 itself can define the ultrasonic transducer 10. As discussed above, a separate ultrasonic transducer 10 can be disposed within the motor 80 for producing the ultrasonic frequency 480 that is transferred through the drive shaft 86, the drum 12 and into the tuned resonating plates 470. This ultrasonic frequency 480 is then delivered into the drum 12 as the ultrasonic resonance 22 that can act upon the entrapped water 16 within the laundry. Where the tuned resonating plates 470 are used, each tuned resonating plate 470 can be attached to a dedicated ultrasonic transducer 10 that acts directly upon the tuned resonating plate 470. Various transducers can be attached to the resonating plate 470 so that various portions of each tuned resonating plate 470 can be set to resonate at a particular frequency. In such an embodiment, the resonating plate 470 can be divided into sub-plates that are each in communication with a dedicated ultrasonic transducer 10. The tuned resonating plates 470 are tuned to an appropriate frequency or various frequencies to transmit and/or amplify the ultrasonic resonance 22 produced by the ultrasonic transducer 10. Accordingly, the tuned resonating plates 470 transfer the ultrasonic resonance 22 from the ultrasonic transducer 10 and relay this ultrasonic resonance 22 into the drum 12 to treat the entrapped water 16 within the laundry.

According to various aspects of the device, the ultrasonic transducers 10 produce an ultrasonic resonance 22 in the form of a high acceleration vibration that includes little displacement within the transducer 10 itself. According to at least one aspect of the device, a magneto-strictive transducer can be used to create this ultrasonic resonance 22 or ultrasonic vibration. A magneto-strictive transducer can be mounted to a stationary plate or a plurality of stationary plates that are allowed to vibrate relative to the drum 12. In a least one example, the metal plate can be in the form of a bulkhead 490 or back wall of the dryer or a door 492 of the dryer, where the bulkhead 490 and the door 492 at least partially enclose and each define a portion of the interior chamber 18 of the drum 12. As discussed previously, various plates used within the drum 12 can be perforated or can include various apertures 532 to allow the fine droplets of entrapped water 16 to escape for removal from the laundry and also from the appliance 14. The magneto-strictive transducers can be in the form of Terfenol-D that is attached to the plate to create the ultrasonic vibration.

Figure 24:
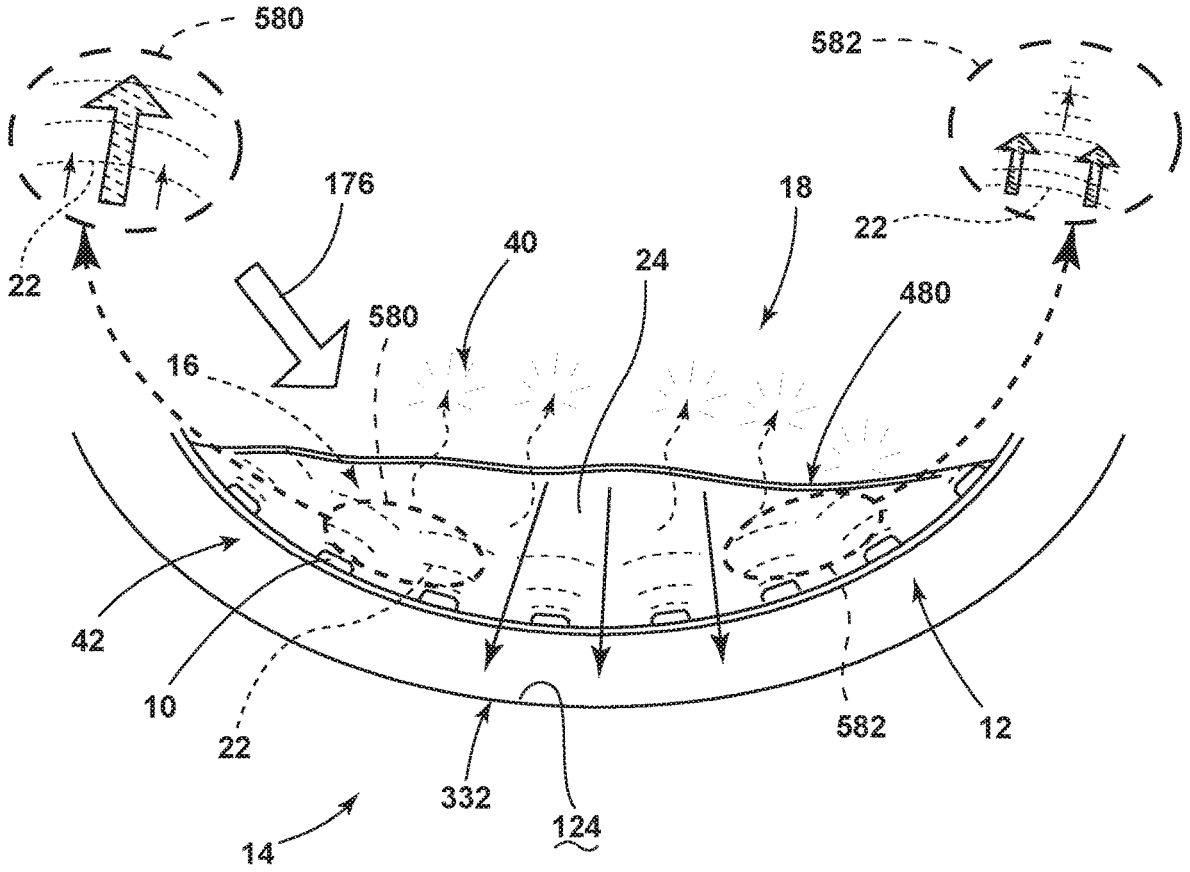
FIG. 24 is a schematic diagram illustrating a moisture delivery system for removing the fine mist from the drum.

Referring now to FIGS. 23 and 24, the various plates in the drum 12 can be used in conjunction with airflow structures and a baffle design that can move clothing and air through the drum 12. The baffle design, such as in the form of lifters 98 within the drum 12, can move or tumble clothing to allow for turnover of loads 24 so that all of the load 24 engages the ultrasonic transducers 10 and/or the resonating plates 470 attached thereto. Through the course of the performance of the drying operation 174, the entrapped water 16 can be converted into the mist for removal from the laundry. During the course of the drying operation 174, the ultrasonic transducers 10 can be turned on and off by using torque information of the motor 80 to determine when the load 24 is contacting an area affected by the transducers 10. As discussed above, this area can be defined by the home position 332 of the drum 12 that is typically the area of the lowest portion of the drum 12 when the area is stationary or as the drum 12 rotates about the rotational axis 290.

Various sensors 310 such as infrared or piezoelectric devices can also be used to determine the location of the load 24 with respect to the ultrasonic transducers 10 and/or the plates attached thereto. An airflow can be produced through the drum 12 for moving the fine droplets of water from the load 24 and either through an exhaust duct within the drum 12 or through perforations or other apertures 532 defined within a wall of the drum 12. The magneto-strictive transducer can use various ferromagnetic materials that tend to change their shape during a process of magnetization. When the magnetic field is applied to the ferromagnetic material, boundaries between various domains within the ferromagnetic material shift and the domains rotate. Each of these effects cause a change in the material's dimension. This change in the materials' dimension can be used to produce the ultrasonic vibration or ultrasonic resonance 22 that can be applied to entrapped water 16 within the laundry. Various shapes of magnetic fields can be applied to the ferromagnetic material to produce a different result and effects and, in turn, different types and directions of deflection within the material that can be used to produce selectively adjustable and varying frequencies and orientations of the ultrasonic resonance 22 that is applied to the entrapped water 16 within the laundry.

Figure 6:
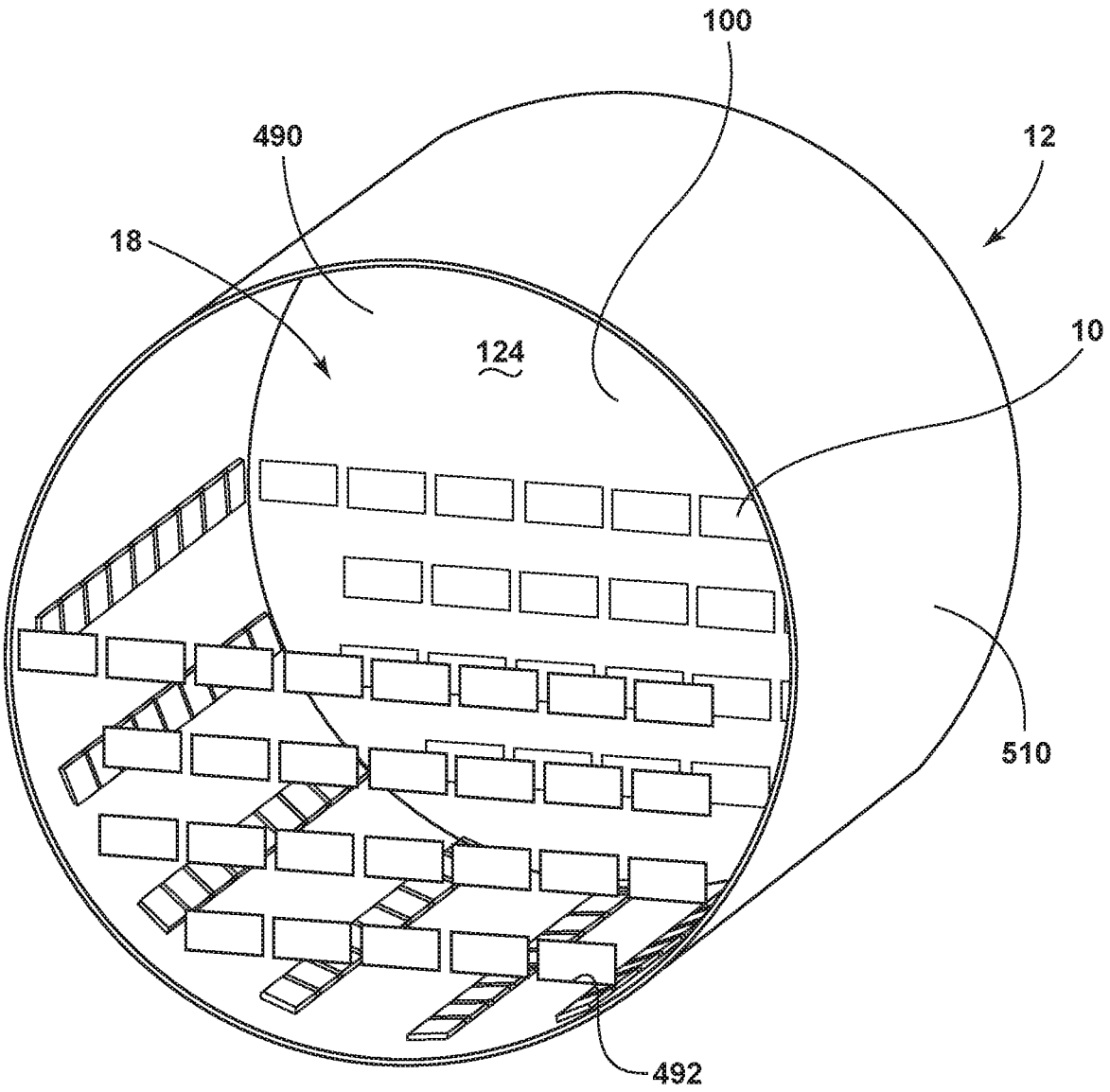
FIG. 6 is a schematic perspective view of a laundry drum having a plurality of ultrasonic transducers positioned therein.

Referring now to FIG. 6, the drum 12 can include ultrasonic transducers 10 that are placed in various locations within and about the drum 12. For transducers 10 that are placed on the rotational portion of the drum 12, these transducers 10 rotate with a drum 12 during performance of the drying operation 174. As discussed above, delivering electrical power and also providing for data communications between these operable transducers 10 that are placed on rotational portions of the drum 12 may use movable electrical connections or wireless electrical connections for delivering electrical power and/or various forms of energy to operate the ultrasonic transducers 10. The ultrasonic transducers 10 can also be placed on stationary portions 100 of the drum 12 such as within a rear bulkhead 490 or within the door 492 of the appliance 14 to define at least a portion of the interior chamber 18 of the drum 12. In these portions, the transducers 10 can be stationary with respect to the appliance structure during operation of the drum 12. Transducers 10 in this area can be hardwired to a power source 92 for the appliance 14 as well as a communications or control portion of the appliance 14. Since these portions do not move during operation of the appliance 14, hardwired connections may be readily available for use. In various aspects of the device, the ultrasonic transducers 10 can be placed on both stationary portions 100 and operable portions 510 of the drum 12.

In such an embodiment, the transducers 10 are selectively operable depending upon those ultrasonic transducers 10 that are directly engaged with the laundry and/or the entrapped water 16 within the laundry. Where the ultrasonic transducers 10 are disposed on stationary portions 100 of the drum 12, the drum 12 can include various lifters 98 or internal deflecting features that can direct the clothing to the bulkhead 490 and/or the door 492 so that the laundry can directly engage the ultrasonic transducers 10 within the stationary portions 100 of the drum 12.

Figure 7:
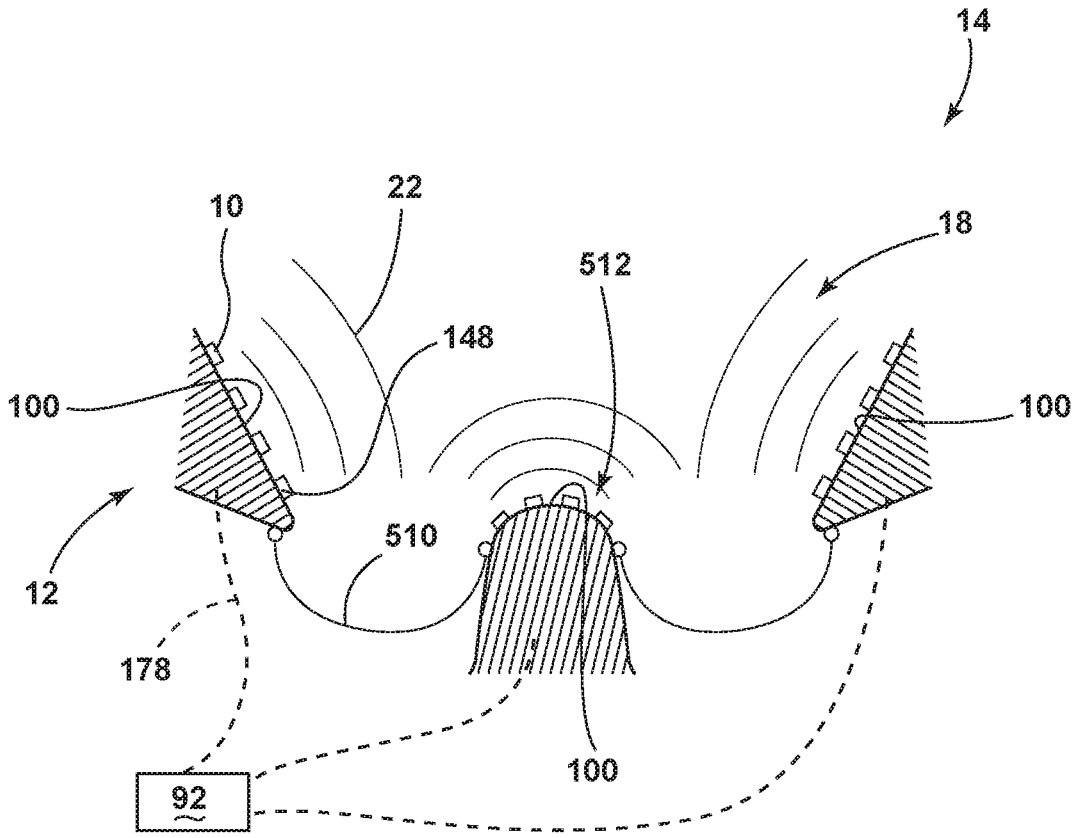
FIG. 7 is a cross-sectional view of a laundry drum having multiple stationary portions with ultrasonic transducers positioned thereon.
Figure 8:
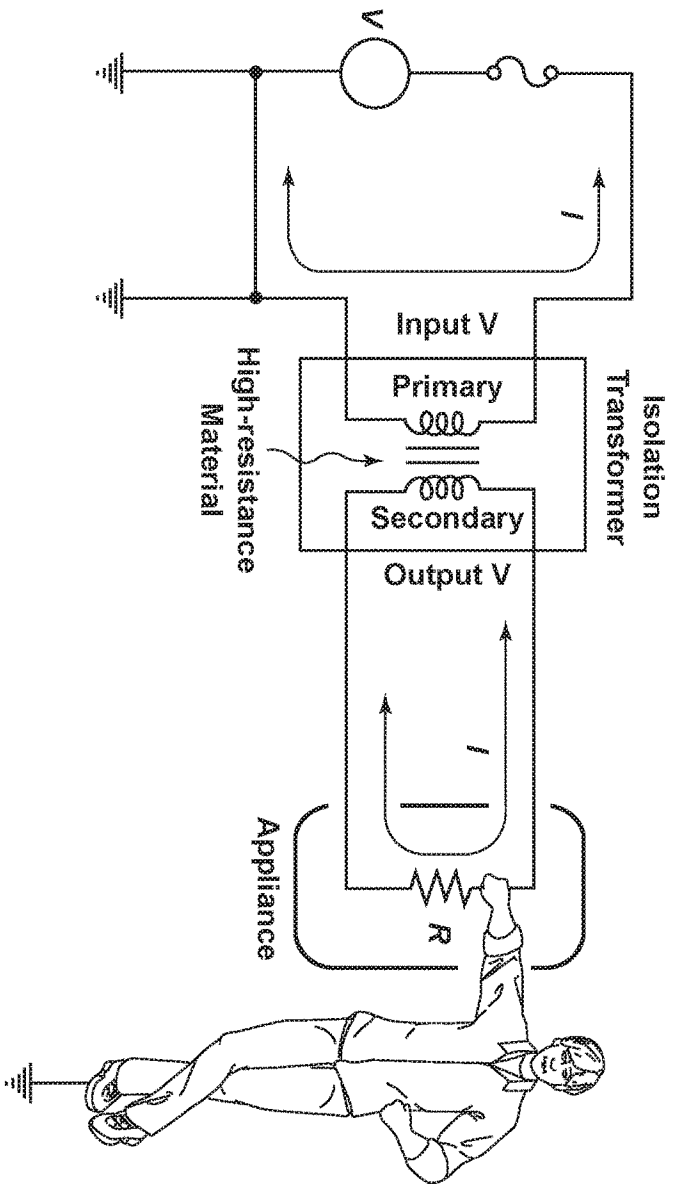
FIG. 8 is a schematic diagram illustrating an aspect of the power system for operating the ultrasonic transducers.
Figure 10:
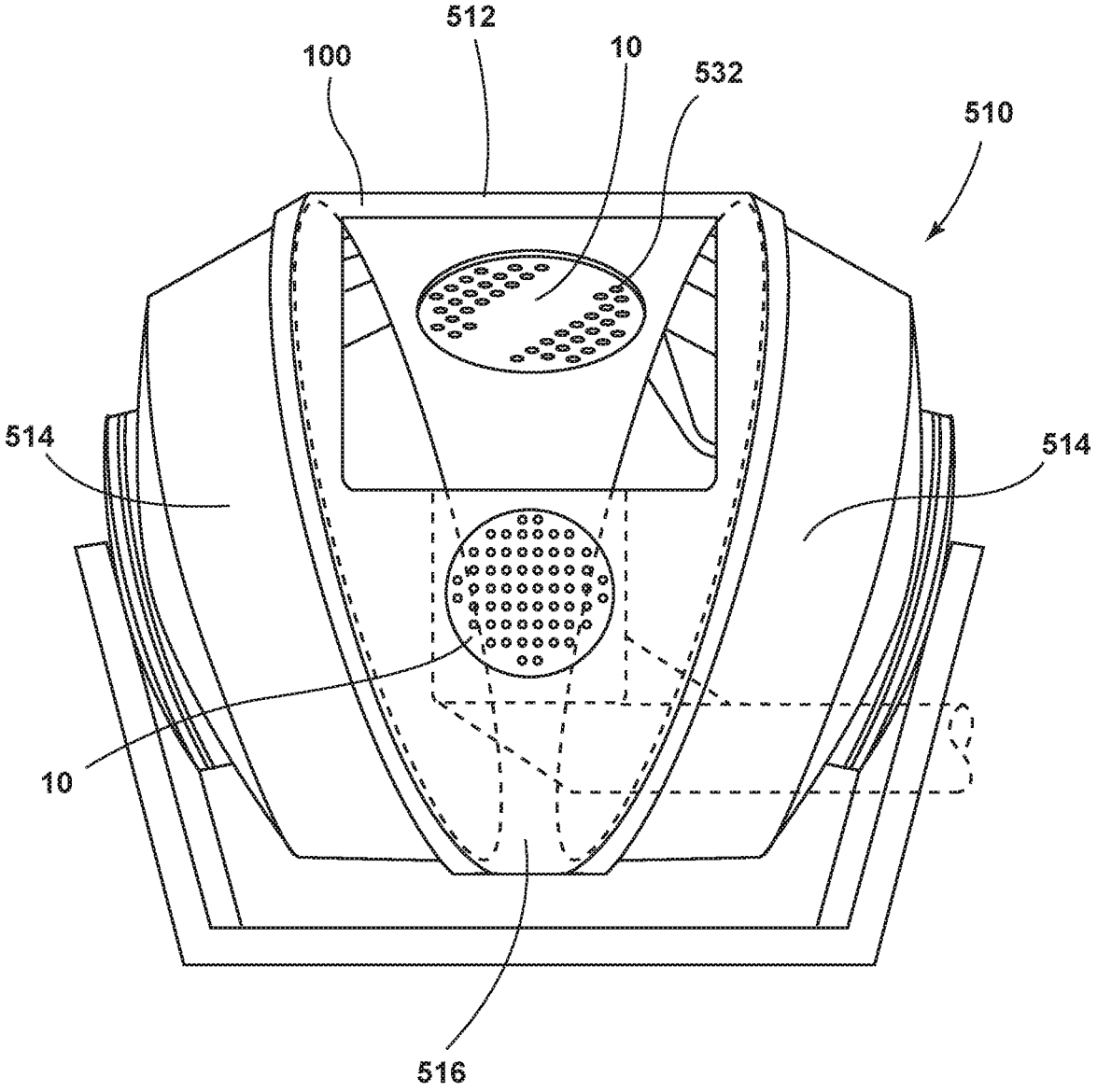
FIG. 10 is a perspective view of a laundry drum having a central stationary portion and outer rotating ends.

As exemplified in FIGS. 6, 7 and 10, the drum 12 can be made of one or more operable portions 510 that are positioned around or near one or more stationary portions 100. The operable portions 510 rotate about the stationary portions 100 so that laundry can be delivered into direct engagement with the stationary portions 100 where the ultrasonic transducers 10 are positioned. In at least one aspect of the device, a center portion 512 of the drum 12 can be stationary and the ultrasonic transducer 10 is disposed at a bottom portion 516 of this stationary component. Typically, this bottom portion 516 of the stationary component can be comparable to the home position 332 of a fully operable drum 12. The center portion 512 can be fully cylindrical or can have wider and narrower portions at the top and/or bottom of the stationary portion 100.

Adjacent to the stationary portion 100 of the drum 12 are one or more operable end pieces 514 that can be rotationally operated relative to the stationary portion 100. These operable end pieces 514 can be sloped or otherwise adapted to direct the laundry toward the stationary component, and in particular, toward the bottom portion 516 of the stationary component where the ultrasonic transducers 10 are located. The rotationally operable portions 510 of the drum 12 can each include lifters 98 or other deflecting features that can direct the laundry toward the ultrasonic transducers 10. Because the ultrasonic transducers 10 are stationary, electrical wiring can be moved through a conduit for delivering electricity thereto and also for providing data communications to and from the ultrasonic transducers 10. It should be understood that other configurations of operable and stationary portions 510 of the drum 12 can be used where the operable portions 510 of the drum 12 manipulate the laundry to be directed to a stationary portion 100 having one more ultrasonic transducers 10 disposed therein. Where a combination of stationary and operable portions 100, 510 of the drum 12 are included, the ultrasonic transducers 10 can be disposed on both the stationary and operable portions 100, 510 to maximize the conversion of the entrapped water 16 within the laundry into the fine droplets of mist.

According to various aspects of the device, the ultrasonic transducers 10 can be incorporated within or connected to one or more printed circuit boards 530 (shown in FIG. 4) that are mounted onto an outer surface 94 of the drum 12. The printed circuit boards 530 can include integrally defined ultrasonic transducers 10 that can either protrude into the rotating drum 12 or can attach to vibrating members that are affected by the ultrasonic transducers 10 for producing the ultrasonic resonance 22 that acts upon the entrapped water 16 within the laundry. The printed circuit boards 530 are adapted to transform a 60 Hz 120-volt AC signal, or alternatively, a 12-volt DC signal, into an appropriate wave form for driving one or more components situated within the rotating drum 12. These components are typically in the form of ultrasonic transducers 10 that emit the ultrasonic resonance 22.

The printed circuit boards 530 can include various sensors 310 and electrodes 148 for receiving power from an electrical system of the appliance 14. The printed circuit boards 530 can also provide for communication between the ultrasonic transducers 10 and a control module for operating the ultrasonic transducers 10 and the appliance 14 as a whole. The sensors 310 that are included within the printed circuit board 530 can include moisture sensors, heat sensors, timers, vibration and/or displacement sensors, combinations thereof and other similar sensors 310.

The printed circuit boards 530 can also include apertures 532 through which the fine droplets of water can travel after the ultrasonic transducers 10 have acted upon the entrapped water 16 within the laundry. The printed circuit boards 530 can also be adapted to operate at least one fan 534 positioned at an outside of the drum 12 for drawing air and the micro-droplets of water from the drum 12 and away from the laundry. The printed circuit boards 530 can be integrally formed within an outer surface 94 of the drum 12 or can be attached thereto via various attachment mechanisms. Various circuit board receptacles 536 can be formed within an outer surface 94 of the rotating drum 12. The printed circuit boards 530 can then be disposed within the circuit board receptacles 536. The printed circuit boards 530 can also be disposed within a portion of the lifters 98 that are attached to an inside surface of the drum 12. These printed circuit boards 530 can be separated from the internal chamber where the laundry is treated by the ultrasonic transducers 10. The printed circuit boards 530 can be placed in communication with the various ultrasonic transducers 10 for activation and deactivation as provided for by the control module and the sensors 310.

Referring again to FIGS. 1-7, 9 and 13-15, where the rotating drum 12 utilizes a high speed or high-G rotating system that serves to satellize at least a portion of the laundry against the inner surface 96 of the drum 12, the control module can utilize a feedback loop to insure continual drying during this high-G rotation of the drum 12. In such a feedback loop, the output generated by the ultrasonic transducer 10 is taken into consideration in determining the following input of the ultrasonic transducer 10. This can be useful as the optimum frequency that the ultrasonic transducer 10 operates may change over the course of a particular drying operation 174. As different types of fabric engage a particular ultrasonic transducer 10 or array of ultrasonic transducers 10, the optimal frequency may change. Additionally, as the fabric dries during the course of the drying operation 174, this optimal frequency may also change. Because the frequency changes throughout the drying operation 174, the harmonics or the appropriate resonance of the various materials of the laundry and the drum 12 can be considered in the design to optimize the drying operation 174 using the ultrasonic transducers 10. A particular circuit related to the ultrasonic transducers 10 can be adapted to analyze the power factor for each ultrasonic transducer 10 or array of ultrasonic transducers 10. If the load 24 provided to the ultrasonic transducer 10 appears to be significantly inductive or significantly capacitive, the control module is adapted to shift or modulate the frequency of the powering signal delivered to the ultrasonic transducers 10 in order to compensate for this change in the harmonics of the drum 12 and/or the load 24. This compensation would serve to tune the load 24 back to the purely resistive load 24 that is found during harmonic conditions. These harmonic conditions are typically present when the ultrasonic transducers 10 are operating at an optimal level and acting upon entrapped water 16 within the load 24 of laundry. Stated another way, where a harmonic condition is not present within the ultrasonic transducer 10 in the laundry, the frequency of the powering signal can be modified to achieve these harmonic conditions. In this manner, where inductive or capacitive conditions are present, the control module or other circuit within the system is adapted to recognize this condition and modify the frequency of the powering signal to achieve the desired harmonic conditions that are indicative of the ultrasonic transducer 10 acting to modify the entrapped water 16 into a fine mist 40 that can be suspended in air and removed from the drum 12.

The system of the ultrasonic transducers 10 can operate through the application of multiple different wave forms among the various drying operations 174 and also within each phase of a drying operation 174 and throughout the course of any one or more of the drying operations 174. Accordingly, the wave forms that are applied through the use of the ultrasonic transducer 10 can be modified continually through the course of the drying operation 174. The wave forms used through the use of the ultrasonic transducers 10 can include, but are not limited to, square wave, sinusoid, triangle wave, saw tooth wave, impulse function, and other similar wave forms that can be used during operation of the ultrasonic transducer 10 for acting upon the entrapped water 16. The various wave forms can be generated directly by the ultrasonic transducers 10. These wave forms can also be generated as a result of the ultrasonic transducers 10 acting upon a separate carrier, such as the tuned resonating plates 470 described herein, where the tuned panels generate the ultrasonic resonance 22 that is used to modify the entrapped water 16 into the mist that can be removed from the drum 12.

According to various aspects of the device, two or more ultrasonic transducers 10 can act simultaneously and in different frequencies or wave forms in order to create a super position of waves to magnify a particular frequency within a desired location. By way of example, and not limitation, two or more ultrasonic transducers 10 can operate in a particular direction and at predetermined frequencies. Where these frequencies intersect at a particular location within the drum 12, these wave forms produced by these frequencies may be super positioned 580 relative to one another to produce the sum of the individual wave displacements that may result in a greater magnitude than the amplitude of the frequency output by the ultrasonic transducers 10.

Similarly, the combination of wave forms produced by the ultrasonic transducers 10 can result in fine-tuning of the frequencies in the form of interference 582 and/or super positioned 580 of waves within the drum 12. In such an embodiment, certain ultrasonic transducers 10 may be supporting transducers 10 that provide targeted frequencies that can be used to super position 580 or interfere with the frequencies of other ultrasonic transducers 10. The super positioned 580 and interference 582 wave forms produced by the ultrasonic transducers 10 can result in fine tune outputs of the ultrasonic transducers 10 as a system that can achieve desired results within various types of fabric, various moisture levels, and various sizes of loads 24 of fabric. To produce the super positioned 580 and interference 582 wave forms, the various ultrasonic transducers 10 can be positioned to intentionally produce or prevent such phenomena from occurring within the drum 12 during a particular drying operation 174.

Figure 25:
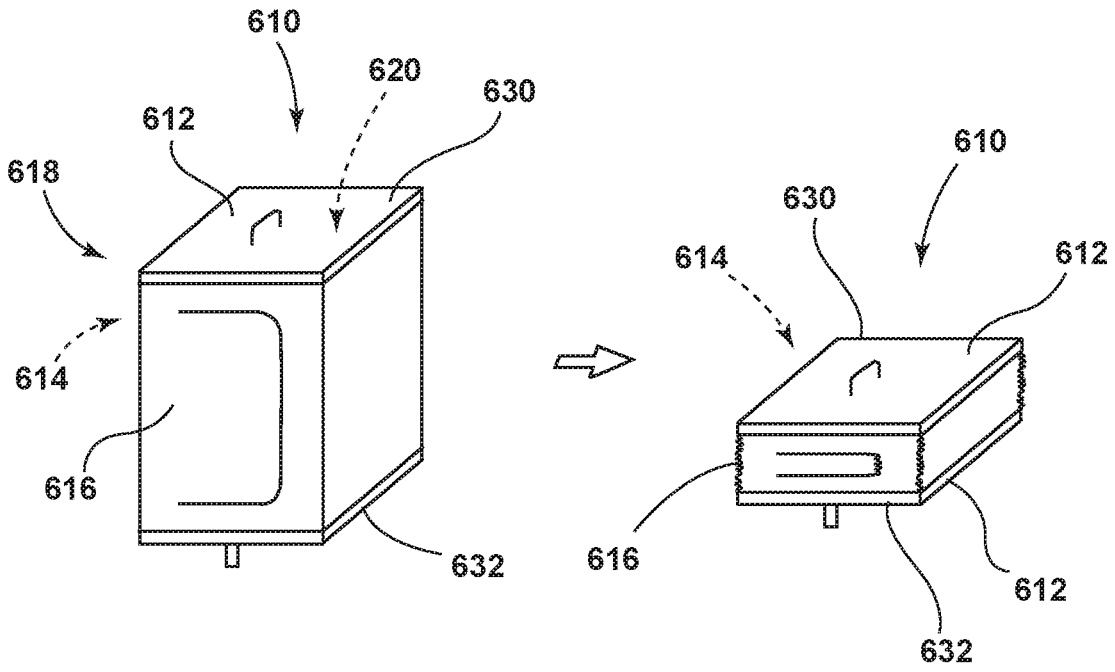
FIGS. 25 and 26 are perspective views of a French-press laundry appliance incorporating ultrasonic transducers.
Figure 26:
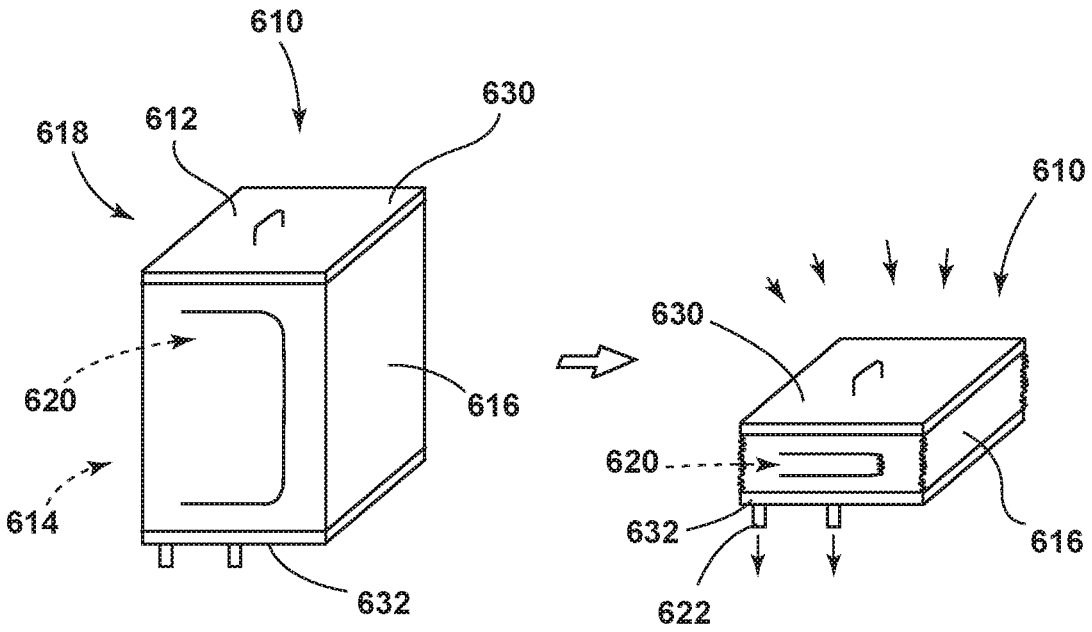
Figure 27:
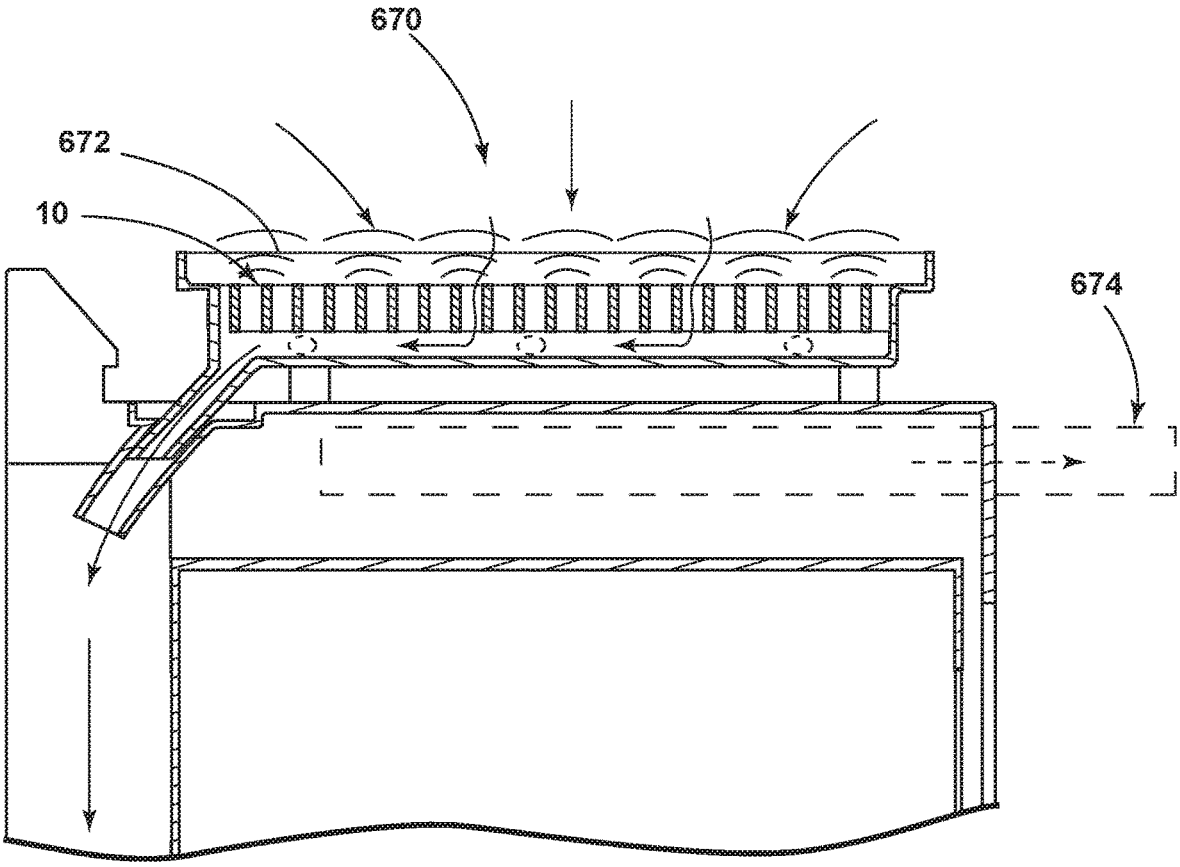
FIG. 27 is a cross-sectional view of a table-top laundry appliance that incorporates ultrasonic transducers.

Referring now to FIGS. 25-27, the ultrasonic transducers 10 can be used within drying appliances other than those containing a rotating drum 12. Certain drying appliances, commonly referred to as a French press 610, can include opposing plates 612 that are moved toward one another to form an adjustable interior volume. The plates 612 press down upon a certain item of clothing or items of clothing. Heat and/or air is moved through the opposing plates 612 so that entrapped moisture within the clothing is heated, evaporated and removed from between the opposing plates 612 of the laundry appliance 14. The ultrasonic transducers 10 can be incorporated within such an appliance 14, where the ultrasonic transducers 10 are attached to one or both of the opposing plates 612. The opposing plates 612 can be connected by a collapsible frame 614 and can include a substantially flexible outer curtain 616 that can extend and collapse along with the movement of the collapsible frame 614. Within the collapsible frame 614 and the outer curtain 616, a door slit, panel, or other similar operable aperture 532 can be positioned so that clothing can be disposed between the opposing plates 612 when the collapsible frame 614 moves the opposing plates 612 to an extended state 618. With the clothes disposed within a fabric treating chamber 620 of the French press 610, and air pump 622 or similar suction device can be applied to the opposing plates 612 to extract air from within the fabric treating chamber 620 defined by the opposing plates 612 and the outer curtain 616. As the air pump 622, such as a vacuum, operates, air is removed from the fabric treating chamber 620 and the opposing plates 612 are compressed toward one another as a result of the generation of the partial vacuum within the fabric treating chamber 620. As the opposing plates 612 near one another, ultrasonic transducers 10 within each of the opposing plates 612 are activated when the various ultrasonic transducers 10 engage the item of laundry within the fabric treating chamber 620. The ultrasonic transducers 10 act upon the entrapped moisture within the laundry and create the fine mist 40 that can be removed along with the air that is being extracted as a result of the operation of the air pump 622. Accordingly, as the ultrasonic transducers 10 operate, the fine mist 40 is created that can be extracted from the treatment chamber along with the rest of the air that is being suctioned out by the air pump 622.

According to various aspects of the device, the collapsible frame 614 can include a locking mechanism that retains the collapsible frame 614 in the extended state 618. After the clothes are loaded within the treatment chamber, the locking mechanism can be released. Upon release of the locking mechanism, the upper plate 630 can move, according to at least the force of gravity, toward the lower plate 632 and rest upon the clothing disposed within a treatment chamber and upon the lower plate 632. At this point, the ultrasonic transducers 10 and the air pump 622 can each be activated at the same time, or sequentially. The ultrasonic transducers 10 act upon the entrapped water 16 within the laundry to create the fine mist 40. The air pump 622 operates to suction at least the humidified air and the fine mist 40 out from the treatment chamber so that the moisture that was entrapped within the laundry can be removed from the treatment chamber and from the clothing. In various aspects of the device, the vacuum can be activated first, and then the ultrasonic transducers 10 can be subsequently activated. In the various embodiments discussed herein, it is the goal of the ultrasonic transducers 10 and the vacuum to work cooperatively to create and remove the fine mist 40 that can be easily and conveniently removed from the treatment chamber. Accordingly, this process can be used on certain articles of clothing to remove entrapped water 16 contained therein. As discussed previously, the use of the ultrasonic transducers 10 can generate the fine mist 40 without the use of heat. Because heat is not included within the drying operation 174, shrinkage and other heat-related damage that may typically be seen in conventional laundry appliances can be kept to a minimum.

Referring again to FIGS. 25-27, various aspects of the French press 610 can include a semi-permeable outer curtain 616 that can allow process air 176 to be passed through the treatment chamber during operation of the ultrasonic transducers 10. In such an embodiment, the opposing plates 612 can be mechanically moved toward one another by some form of pressing operation. Simultaneously, air can be transmitted through the permeable curtain and through the treatment chamber so that the fine mist 40 that is produced by the ultrasonic transducers 10 acting on the entrapped water 16 can be removed through the permeable outer curtain 616. The air can also be moved through the opposing plates 612 so that air is moved in a generally perpendicular direction through the items of clothing for removing the fine mist 40 from the treatment chamber. Where the air is moved through the opposing plates 612, the outer curtain 616 may be permeable or non-permeable, depending on the needs of the user.

The French press 610 style of laundry device is typically designed for treatment of minimal numbers of clothing that are dried and stored in a flat and substantially unfolded condition. Accordingly, the French press 610 can include various heating features that can be used in conjunction with the ultrasonic transducers 10 to provide a permanent press or wrinkle release phase of the drying operation 174. In such an embodiment, the heating device can be used to increase the temperature of the fine mist 40 generated through operation of the ultrasonic transducers 10. This heated mist or heated air 694 can be moved through the items of clothing contained in a treatment chamber. The movement of the heated mist in conjunction with the pressing operation of the opposing plates 612 can serve to act as a type of pressing iron for removing wrinkles from the various items of clothing contained in the treatment chamber.

According to various aspects of the device described herein, the use of the ultrasonic transducers 10 can act upon the entrapped water 16 within the laundry items to form the mist that can be removed from the treatment area of the particular appliance 14 being used. The operation of generating a fine mist 40 can be in the form of an ultrasonic nebulizer that transfers the entrapped water 16 into a fine mist 40 that can be suspended within air moving through a treatment chamber. This nebulized fine mist 40 can then be moved along with the movement of air for removal from the laundry and from a treatment area of the appliance 14.

According to various aspects of the device, handheld-type appliances 14 can incorporate aspects of the ultrasonic transducers 10. Such appliances 14 can include the handheld iron or wrinkle releasing wand. In such an embodiment, a portion of the handheld laundry appliance 14 can include an array of one or more ultrasonic transducers 10 that can become activated when engaged with laundry that has entrapped water 16 therein. When the ultrasonic transducers 10 engage the entrapped water 16, the ultrasonic transducers 10 are adapted to activate. As discussed above, activation of the ultrasonic transducers 10 converts the entrapped water 16 to a fine mist 40 that is typically lighter than the surrounding air. This fine mist 40 can be removed through the movement of air along or through the item of clothing. The handheld laundry appliance 14 can be moved over the areas of clothing needing to be treated so that entrapped water 16 throughout the treatment areas can be removed during operation of the handheld laundry appliance 14.

The ultrasonic transducers 10 produce the ultrasonic resonance 22, typically a vibration that is of such a frequency that the entrapped moisture is nebulized, atomized, or otherwise converted into ultrafine droplets of water that are characteristic of a fine mist 40 or humidified air. As the ultrasonic transducers 10 operate, the entrapped water 16 is quickly nebulized or atomized so that the entrapped water 16 can be removed from the garment in the vicinity of the contact area where the ultrasonic transducers 10 operate.

The handheld laundry appliance 14 can also include an air handling system 42 such as one or more fans 534 that can move air past the treated area affected by the ultrasonic transducers 10. In addition to moving air, a fragrancing mechanism can be added to the handheld or larger appliance 14 so that air moved through the treatment area can be used to deposit freshening agents, fragrancing materials, refreshing materials, or other similar material that can be moved via the air handling system 42 of the appliance 14. Using the one or more fans 534 or air handling units, the induced airflow can aid the drying process by carrying away the atomized or nebulized water. The movement of air prevents this fine mist 40 from settling back on the garment.

The use of a handheld laundry appliance 14 can incorporate a minimal number of ultrasonic transducers 10. Accordingly, such a handheld laundry appliance 14 can be operated through use of a household outlet and is connected by a power cord. The minimal number of ultrasonic transducers 10 can also be used in conjunction with rechargeable or replaceable batteries that can provide temporary power for operating the ultrasonic transducers 10. Because the handheld appliance 650 is typically used for a small area, typically a few items of clothing or a single portion of one or more items of clothing, the use of a battery operating system or hybrid battery and corded system allows for use of the ultrasonic transducer 10 within the handheld laundry appliance 14 when a cord cannot be conveniently used. The ultrasonic transducer 10 can be used as a travel item that can be used in most any location.

The use of smaller scale appliances 14 that incorporate the ultrasonic transducer 10 can also be incorporated within the larger appliances 14. In such an embodiment, an array of ultrasonic transducers 10 or a single ultrasonic transducer 10 can be included within a standalone appliance 670 that can be set upon or attached to a laundry appliance 14. By way of example, and not limitation, a drying platform 672 can be set upon the top of a drying appliance 14 and connected with a power source 92 for the appliance 14 or a power source 92 near the appliance 14. In this manner, the drying platform 672 can be docked, coupled, or otherwise integrated within the laundry appliance 14. The drying platform 672 can include one or more ultrasonic transducers 10 that can be used to provide heatless or substantially heatless drying functionality to various items of clothing that may be particularly sensitive to heat. The drying platform 672 can also be in the form of a slidable drawer 674 that can be extended or retracted from a housing of the laundry appliance 14. The garment can be placed in a treatment chamber of the drawer 674. When the drawer 674 is closed, the ultrasonic transducers 10 can be activated for removing the entrapped water 16 from the various laundry items being treated therein. In various aspects of such a device, a drying platform 672 can include a porous surface that includes a place to rest and/or press a particular garment or other clothing item with an opposing platform of the device, or with a handheld appliance 650 that may include an ultrasonic transducer 10. The porous surface of the drying platform 672 can allow for the movement of air through the clothing item being dried. Such an attachment or integrated feature can allow for the treatment of multiple items in several different drying operations 174 at the same time. Additionally, where certain items are being treated by an ultrasonic transducer 10, the fine mist 40 generated therein can be used for performing various steam-related operations in adjacent portions of one or more appliances 14.

According to various aspects of the device, the fine mist 40 generated by the ultrasonic transducers 10 can be carried to other portions of a residence for providing humidification functions throughout the household, where the climate may be particularly dry at certain times of the year. The fine mist 40 can also be used for other purposes within the house, such that the fine mist 40 can be captured and repurposed in the form of a fine mist 40 or other forms of moisture.

Figure 28:
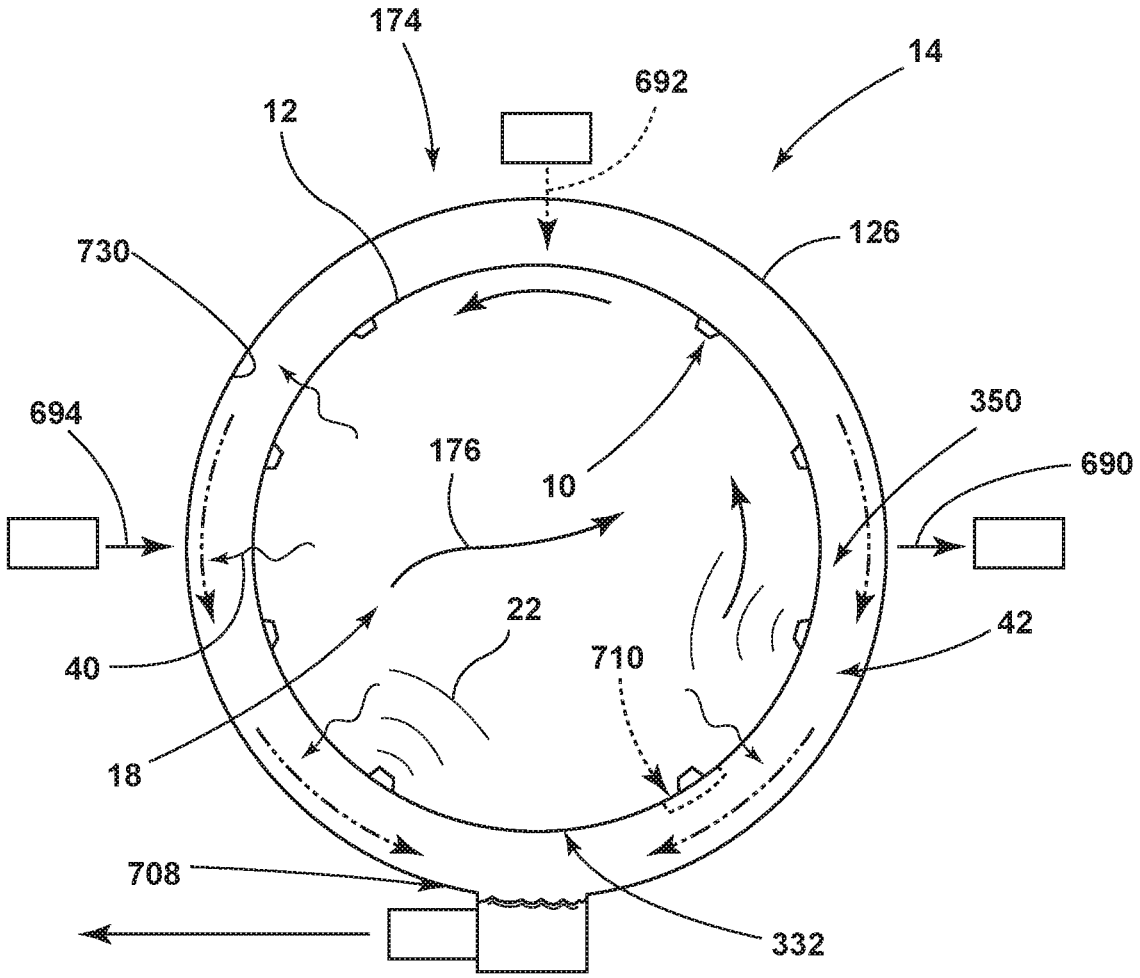
FIG. 28 is a schematic diagram illustrating a moisture handling system for an ultrasonic drying appliance.

According to various aspects of the device, and as generally exemplified in FIG. 28, the ultrasonic transducers 10 can be used in conjunction with other forms of drying technology. These drying technologies can include, but are not limited to, low pressure drying, use of microwaves 692 or RF drying, conventional drying with heated air 694, combinations thereof and other similar drying technologies. Each of these technologies may have one or more drawbacks. However, these drawbacks may be mitigated through the use of multiple technologies within a hybrid system that takes advantage of each of the features of these technologies for maximizing drying efficiency within a particular drying operation 174.

Where ultrasonic transducers 10 are used as part of the drying operation 174, such a system may be less efficient near the end of a particular drying cycle. It may be difficult to place entrapped water 16 that may be within a center of a load 24 of laundry in substantially continuous contact with one or more ultrasonic transducers 10. Accordingly, the use of heated air drying can be used toward the end of a particular drying operation 174 as a finishing step for removing the last undesired portions of entrapped water 16 from the laundry. In such a hybrid system, hot air can be used as a wrinkle release function where the heated air 694 serves to mitigate the presence of wrinkles within the laundry that has been treated through the use of ultrasonic transducers 10. In such a drying operation 174, the first portion of the drying operation 174 can be a non-heat phase where the ultrasonic transducers 10 remove the entrapped water 16 without the addition of heat or without the additional substantial amounts of heat. The entrapped heat is removed in the form of a fine mist 40 that can be delivered from the treatment area through the use of an air handling system 42.

A later phase of the particular drying operation 174 can be typically in the form of a heated air phase 694 where air is heated through the use of a resistive heater, through the use of a heat pump system, or other type of air heating mechanism. The air handling system 42 can then move the heated air 694 through the laundry for performing the wrinkle release function or finishing step of the drying operation 174. The use of the heated air 694 only at the very end of the drying operation 174 can limit the wear on the laundry and also limit the lint generation that may be created through the use of heated air 694.

Where low-pressure drying 690 is utilized, energy is necessary to be added back into the clothing as the entrapped moisture is evaporated under the low-pressure conditions. If energy is not added back into the clothing, the clothing and the remaining entrapped moisture may decrease in temperature to the point of frosting or freezing. Such a condition can stop the process of low pressure evaporation. Because the low pressure environment provides little air in and around the clothing, the addition of heated air 694 would frustrate the low-pressure environment. Additionally, there is little air within the low-pressure environment to heat. The use of microwaves 692 can added to the drying operation 174 for heating the clothing in the remaining trapped moisture. These microwaves 692 can be used to add energy back into the system to prevent the overcooling of the laundry and the entrapped water 16. Certain portions of the removal of moisture could be conducted through the operation of the ultrasonic transducers 10. Because the ultrasonic transducers 10 are typically most effective when larger amounts of entrapped water 16 are present, an initial phase of the drying operation 174 can be used by incorporating the ultrasonic transducers 10 to convert the entrapped water 16 into a fine mist 40 that can be easily removed by moving air through the treatment area. This step of using the ultrasonic transducers 10 can be performed without the use of heat. Where a certain amount of moisture has been removed, a low-pressure drying operation 690 can be instituted to remove additional portions of moisture from the laundry. A finishing phase similar to that described above can be conducted at the end of the drying operation 174 so that heated air 694 can be used to fluff the laundry and provide anti-wrinkling functionality to the drying operation 174.

The ultrasonic transducers 10 and the low pressure drying can also work together to provide better drying functionality as a composite system. As discussed above, energy is preferably added to wet clothing as low pressure allows the evaporation of water from fabric. However, if the water is separated from the clothing first, then evaporated, the energy of evaporation would be extracted from the nebulized moisture more than the clothing. In this manner, a cool effluent of water vapor would tend to condense more quickly as it is pumped out of the treatment area. Therefore, less energy would need to be replaced in the clothing. Accordingly, using the ultrasonic transducers 10 to remove the entrapped water 16 from the laundry, a low-pressure environment can be used to evaporate this fine mist 40. In such a system, the energy extracted from the system for evaporating fluid within the low-pressure environment would be extracted from the fine mist 40 and not from the water entrapped within the clothing. Accordingly, the clothing and the entrapped water 16 would experience cooling to a lesser degree, such that less energy would need to be introduced into the system in the form of microwaves 692 and/or heated air 694. By evaporating the fine mist 40, extraction of water using the ultrasonic transducers 10 may also be efficiently conducted.

It is contemplated that multiple drying technologies can be used within a single drying operation 174. Such combinations of drying technologies can be used within a drying operation 174 so that different types of fabric, different amounts of clothing and different amounts of entrapped water 16, different sizes of loads 24, and other varying conditions within loads 24 of laundry can be treated to maximize the efficiency of the drying operation 174 and minimize drying time. Where the combinations of drying technology are used, technologies that use a higher energy consumption may be limited in use within a particular drying operation 174. Additionally, those technologies that may tend to cause additional wear on the clothing may also be used minimally. Understanding that each of these technologies has its own characteristics and advantages can provide for use of combinations of these technologies to mitigate the drawbacks and maximize the advantages of the various technologies as a composite system for the various drying operations 174 of the laundry appliance 14.

Referring again to FIGS. 1-18 and 28, the operation of the ultrasonic transducers 10 to form the fine mist 40 out of the entrapped water 16 within the laundry is to be removed from the drum 12 via a cooperating operation. Movement of the fine mist 40 can be accomplished through an air handling system 42. Air that may or may not be treated can be moved through a treating area containing the laundry and the entrapped water 16. As the ultrasonic transducers 10 atomize, nebulize, vibrate, or otherwise modify the entrapped water 16 into the fine mist 40, the air handling system 42 moves process air 176 through the treatment area of the laundry appliance 14. The fine mist 40 can be suspended within this process air 176 moved through the treatment area and can be carried with the process air 176 outside of the drum 12 and ultimately outside of the appliance 14.

According to various aspects of the device, when the fine mist 40 is moved outside of the drum 12, the fine mist 40 may be reconstituted into larger droplets and allowed to flow into a drain channel 708 situated near the drum 12, and typically below the drum 12. The captured water moved to the drain channel 708 can then be pumped or otherwise caused to flow out of the appliance 14. This fluid within the drain channel 708 can also be repurposed for other moisture-related functions of the drying appliance 14. Such functions may include, but are not limited to, washing functions, steam-related functions, wrinkle-release functions, fragrancing functions, refreshing functions, cleaning lint filters, cooling condensers, delivered for use as a thermal exchange media, wetting and capturing stray lint, washing various portions of the appliance 14, combinations thereof, and other similar laundry-related operations.

To assist in the movement of the fine mist 40 generated by the ultrasonic transducers 10 through the drum 12, at least a portion of the drum 12 and/or a portion of the ultrasonic transducers 10 can be made from a mesh-type material that includes a plurality of pores or other apertures 532 through which the fine mist 40 can move outside of the drum 12. This mesh can define a surface of the ultrasonic transducer 10 or can be a surface of the drum 12 that surrounds or is placed in contact with one or more of the ultrasonic transducers 10. The mesh can be in the form of a metallic mesh 710, or a mesh made of some other substantially rigid material that can be used to transmit the ultrasonic resonance 22 of the ultrasonic transducer 10 into the load 24 of laundry being treated within the drum 12. The mesh can be made of various materials that can include, but are not limited to, metal, composite, plastic, ceramic, various polymers, combinations thereof, and other similar materials that can be used to transmit an ultrasonic resonance 22 emitted by an ultrasonic transducer 10. The mesh-type configuration of the material can allow for the movement of process air 176 that carries the fine mist 40 therein through the mesh and outside of the drum 12.

The use of the process air 176 can be used in conjunction with a spinning operation of the rotating drum 12 for moving the fine mist 40 to areas outside of the drum 12. As the drum 12 rotates, centrifugal force may act upon the fine mist 40, as well as the entrapped water 16, to push the fine mist 40 toward the inside surface of the rotating drum 12. Because portions of the inside surface of the rotating drum 12 can include pores, apertures 532, mesh-type materials or other openings, the fine mist 40 being acted upon by the centrifugal force of the drum 12 causes the mist to move out of the drum 12. The mist can then be captured outside of the drum 12 and moved to a separate area of the appliance 14 or out from the appliance 14. While the centripetal force of the drum 12 acting upon the laundry keeps the laundry within the drum 12, the centrifugal force of the drum 12 rotating acts upon the fine mist 40 to push the fine mist 40 out from the drum 12 to be captured within a portion of the appliance 14 outside of the drum 12.

In various aspects of the device, when the drum 12 rotates in a high-speed motion to be satellized, the laundry against the inside surface of the drum 12, this action, by itself, may be sufficient to push the fine mist 40 outside of the drum 12 during operation of the ultrasonic transducers 10. In various aspects of the device, the movement of process air 176 through the drum 12 can assist the ultrasonic transducers 10 to generate the fine mist 40 and also move the fine mist 40 outside of the drum 12.

In various aspects of the device, a tub 126 positioned outside the drum 12 can include a capturing surface 730 that receives the fine mist 40 as it is moved outside the drum 12. This capturing surface 730 can receive the fine mist 40 which may tend to adhere to the capturing surface 730. As the fine mist 40 is entrapped on the capturing surface 730, the fine droplets of moisture may coalesce over time into larger and larger droplets. These larger droplets may ultimately become heavy enough such that they can move according to the force of gravity in a generally downward direction toward a drain channel 708. Process air 176 can also be blown within the space between the outside surface of the drum 12 and the capturing surface 730 of the tub 126 for moving the captured moisture toward a drain channel 708 or other moisture capturing compartment. Additionally, a mist of larger droplets or spray of fluid can also be sprayed within the space to capture the fine mist 40 so that all of the moisture can be moved toward a drain channel 708 or other moisture capturing compartment. Heat can also be used to move the fine mist 40 to other portions of the appliance 14 by heating the fine mist 40 into an evaporated vapor that can be moved along with the process air 176 to another portion of the appliance 14 or evacuated from the appliance 14 as a gas.

Where embodiments of the device include a tub 126 or other structure surrounding the drum 12 for capturing the fine mist 40, the tub 126 can be adapted to capture the moisture from the drum 12 during performance of any number of drying technologies that have been described herein. Where a heated air phase 694 is used for removing entrapped water 16 from the laundry, the surface of the tub 126 can be at least partially cooled such that moisture within the heated air 694 may be precipitated from the process air 176 and allowed to funnel down to a drain channel 708 or other fluid capturing container. The tub 126 may be similarly treated for acting upon moisture that is removed during operation of a low-pressure drying operation 690 and/or the use of microwaves 692 as part of a drying operation 174. In addition to a tub 126 that surrounds the drum 12, other surfaces can be positioned around the drum 12 for capturing the moisture extracted therefrom as the fine mist 40. These mechanisms can include vacuums, heat exchangers, channels, grooves, combinations thereof, and other similar mechanical and structural features that are disposed proximate and typically outside of the drum 12. Certain structural features can include capillary-type tubes that can retain the fine droplets of moisture and utilize a process of capillation to move the fluid to a particular location. The process of capillation can also provide for the movement of fluid in a direction contrary to the force of gravity if desired.

Referring again to FIGS. 1-18, various phases, sub-phases and drying routines can be incorporated within the drying appliance 14 for conducting various drying operations 174. The drying operations 174 can be organized based upon fabric type, moisture content, load size, desired finishing moisture content (damp, almost dry, fully dry, etc.), desired energy usage, additional functions (steam, fragrance, refresh, wrinkle release, sanitize, etc.), combinations thereof, and other similar considerations. According to various aspects of the device, as discussed above, various technologies and drying techniques can be used sequentially, simultaneously, and in various combinations and permutations in order to perform any one or more of the drying operations 174. By way of example, and not limitation, an exemplary drying cycle can include various types of drum rotation including high speed drum rotation, low speed drum rotation, partial rotation, full rotation, sequential two-way rotation, eccentric drum movements, and other similar drum movement operations. In at least one aspect of the device, the drum 12 can spin at a high rate so that the load 24 of laundry tends to satellize against the inner surface 96 of the drum 12. As discussed previously, the satellizing of the laundry can cause a majority of fabric to be in contact with the inner surface 96 of the drum 12 where the ultrasonic transducers 10 may be located. In such an embodiment, the ultrasonic transducers 10 can be activated to operate upon a greater amount of entrapped water 16 within the laundry.

The satellizing process 264 can be intermittent with a low-speed operation so that the clothes that are satellized against the drum surface can be acted upon by the ultrasonic transducers 10 so that a majority of the entrapped moisture can be removed. The drum speed can then be reduced to perform a tumbling operation 262 so that the load 24 of fabric can be re-distributed within the drum 12. The laundry can then be satellized again so that portions of the load 24 containing greater amounts of entrapped moisture may be disposed near one or more of the ultrasonic transducers 10. The sequential operation of high speed satellizing and low speed tumbling can continue until a particular moisture content is achieved within the load 24 of laundry. The moisture content can be in the form of an amount of moisture within the laundry, an amount of moisture sensed within the air in and around the drum 12, an amount of mist generated by activation of the ultrasonic transducers 10, or other similar moisture sensing para meter.

Once a particular moisture content is achieved, a heated air 694 flow can work in conjunction with the ultrasonic transducers 10. The flow of air, whether heated, cooled, or untreated, may help transport the moisture mass in the form of the fine mist 40 from the drum 12 to areas outside of the drum 12. The heated air 694 can also reduce the viscosity of the fluid and allow for more moisture to be removed at any given time. By decreasing the viscosity of the moisture in the clothing, the satellizing operation of the dryer may result in greater amounts of moisture being moved by centrifugal force toward the inner surface 96 of the drum 12. Once near the inner surface 96 of the drum 12, the ultrasonic transducers 10 can be activated to operate on this entrapped moisture within the laundry. The lower viscosity of the fluid can also result in certain amounts of moisture being moved as droplets of water through apertures 532 within the drum 12 and into areas outside of the drum 12 for capture and movement away from the laundry. The use of heated air 694 in the ultrasonic transducers 10 can be used in combination. In such an embodiment, the ultrasonic transducers 10 and heating mechanism can be selectively activated and deactivated as needed to maximize the nebulization, atomization or other similar manipulation of the entrapped water 16 into the fine mist 40 for removal from the drum 12.

According to various aspects of the device, the ultrasonic transducers 10 can be activated and deactivated as necessary. The ultrasonic transducers 10 may be activated when in contact with the entrapped water 16 and/or a portion of the load 24 of laundry. The ultrasonic transducers 10 that are not in direct contact with either the entrapped water 16 or the load 24 of laundry can be selectively deactivated until such time as direct contact is reestablished with the water and/or laundry. Where a tumbling operation 262 is being conducted, those transducers 10 that are in or near the home position 332 of the drum 12 can be activated. Those ultrasonic transducers 10 that are away from the home position 332 can be selectively deactivated until the rotation of the drum 12 returns these ultrasonic transducers 10 to the home position 332 for reactivation.

During the decreased drum speed that results in a tumbling or redistribution operation, the drum 12 can move various rotational distances 172 to maximize the amount of mixing of the laundry or redistribution of the laundry. This maximized redistribution can result in higher efficiencies of removal of the entrapped water 16 from the laundry during a subsequent satellizing operation. In addition to rotation of the drum 12 about a rotational axis 290, certain eccentric movements of the drum 12 can also be used where the drive shaft 86 of the tub 126 is allowed to move in a direction perpendicular to the rotational axis 290. These eccentric movements may assist in tumbling of the laundry, such that a figure-eight movement of the drum 12 in the laundry can be achieved for greater load 24 redistribution.

Within the laundry appliance 14, the ultrasonic transducers 10 can be located in various locations proximate the drum 12. The ultrasonic transducers 10 can be placed along an inner surface 96 of the drum 12, along various stationary surfaces proximate the drum 12 such as a bulkhead 490 or door 492 of the appliance 14. Where the ultrasonic transducers 10 are placed in a stationary location, operation of the drum 12 serves to move the laundry in contact with these stationary ultrasonic transducers 10 to remove the entrapped water 16 from the load 24 of laundry. To assist in the redistribution of the laundry, reverse tumbling or tumbling of the laundry in clockwise and counterclockwise directions may be implemented for greater redistribution of the items of fabric within the load 24 of laundry.

To assist in the various sensing operations of the laundry appliance 14 to determine the efficiency of the ultrasonic transducers 10, various sensors 310 can be connected to the ultrasonic transducers 10 for monitoring the amount of moisture being nebulized and/or atomized by the ultrasonic transducers 10. The appliance 14 can also measure the amount of voltage being delivered to a particular ultrasonic transducer 10 or group of ultrasonic transducers 10. In such an embodiment, as the load 24 of laundry is being dried by the ultrasonic transducers 10, the load 24 inherently reduces in the mass of moisture entrapped therein. The ultrasonic transducers 10 can be used as a sensor 310 to detect this phenomena via voltage differences in the ultrasonic transducers 10. These voltage differences can be measured according to the weight of the laundry that is placed upon each of the ultrasonic transducers 10. Where the weight of the laundry decreases a sufficient amount, this signal may be indicative of a certain amount of moisture and a potentially desired amount of moisture being removed from the load 24 of laundry. The lesser weight of the laundry or lower voltage sensed by the ultrasonic transducer 10 as a result of the impact of the load 24 of laundry against the ultrasonic transducer 10 may also be indicative of the need for a redistribution phase of the laundry operation. Where this lower voltage is reached, this may commence a redistribution operation. Where the redistribution operation results in a greater voltage sensed by the ultrasonic transducer 10 resulting from the weight of the laundry, the laundry operation may continue. Where the redistribution phase does not result in a changed voltage, this may be indicative of the stopping of the laundry operation or, in various embodiments, activation of a finishing sequence where heated air 694 is used to refresh and conduct a wrinkle release phase upon the load 24 of laundry.

According to various aspects of the device, the ultrasonic transducers 10, as a consequence of their mode of operation, can be used as a sensor 310 for load size detection as well as moisture level detection. Where the ultrasonic transducer 10 is a piezoelectric sensor 310, the amount of deflection experienced by the piezoelectric transducer 10 may correspond to a certain amount of weight or mass that is placed upon the ultrasonic transducer 10. As discussed previously, this amount of weight or mass can be indicative of a certain moisture content of the load 24 of laundry, a certain size of a load 24 of laundry, and other various mass-related indicators.

During performance of the drying operation 174, the power to the ultrasonic transducers 10 can be increased or decreased to achieve a uniform and efficient drying rate. As discussed previously, certain fabrics, certain moisture contents, and other certain factors present within the laundry may react more efficiently to the ultrasonic transducers 10 at a particular operational frequency or ultrasonic resonance 22. The various ultrasonic transducers 10 can be powered in different magnitudes in order to achieve a desired ultrasonic resonance 22 that results in an optimum or substantially optimum nebulization or atomization of the entrapped water 16 within the load 24 of laundry.

In addition to changing the frequencies of the various ultrasonic transducers 10, single-frequency ultrasonic transducers 10 can be installed within the drum 12. The various single-frequency ultrasonic transducers 10 can each include a different operational frequency. Accordingly, an array of ultrasonic transducers 10 may each operate at a particular frequency. However, the various ultrasonic transducers 10 may each operate at a different frequency such that at least one of the ultrasonic transducers 10 can be utilized for optimal drying within a load 24 of laundry. Where a particular ultrasonic transducer 10 is not being optimized, power to that ultrasonic transducer 10 may be diminished or shut off until such time as that frequency of ultrasonic transducer 10 may become more efficient.

The laundry appliance 14 can include a single ultrasonic transducer 10 that is adapted to vibrate the entire drum 12 at a particular ultrasonic resonance 22 or a variety of ultrasonic resonances 22. In such an embodiment, the ultrasonic transducer 10 may operate within a certain portion of the drum 12 or within a motor 80 or drive shaft 86 of the drum 12 so that the ultrasonic transducer 10 can transmit the particular vibration frequency through the material of the drum 12 and into the interior chamber 18 of the drum 12 for treatment upon the entrapped water 16 within the laundry.

In various aspects of the device, the ultrasonic transducers 10 may tend to generate heat during operation. This is particularly true when the ultrasonic transducer 10 is not acting upon entrapped moisture within the laundry. When not in use, an ultrasonic transducer 10 may be modified to receive a diminished amount of power. The ultrasonic transducer 10 may also be maintained at the particular frequency of operation 350. The heat generated during operation of the ultrasonic transducer 10 may be directed into the drum 12. This heat generated can allow the drum 12 to be used as a heat sink. The heat entrapped within the drum 12 can be transferred into the load 24 of laundry and/or into the trapped fluid within the laundry for increased efficiency of atomization of the entrapped water 16. This heat may also be used to heat process air 176 that is moved into and through the drum 12. The heat emitted by operation of the ultrasonic transducers 10 may also be used to heat the drum 12, where this heat may also be used for other operations outside of the drum 12 within other parts of the appliance 14.

It is contemplated that the ultrasonic transducers 10 can be used in various appliances 14 and fixtures. Such appliances 14 and fixtures can include, but are not limited to, washers, dryers, combination washer/dryers, dishwashing appliances, refrigerators, humidors, coolers, air conditioners, humidifiers, dehumidifiers, and other similar appliances 14. By way of example, and not limitation, where an appliance 14 has the need for removal of moisture from a certain compartment or certain area of the appliance 14, the ultrasonic transducers 10 can be utilized for atomizing, nebulizing, or otherwise transforming this moisture into fine droplets of mist for removal from that area of the appliance 14.

It will also be appreciated that various aspects described above, particularly as to how power is supplied to a rotating drum, may be used with other drying technologies, such as radio frequency drying technologies.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

The invention claimed is:

1. A laundry appliance comprising:

a cabinet having a rotating drum operably positioned therein for processing fabric; and at least one transducer positioned proximate the rotating drum that provides an ultrasonic resonance that is directed into an interior chamber of the rotating drum; wherein the ultrasonic resonance is adapted to be directed into damp fabric being treated within the interior chamber; and the ultrasonic resonance modifies water trapped within the damp fabric into a substantially gaseous form.

2. The laundry appliance of claim 1, wherein the at least one transducer is electrically connected to the laundry appliance.

3. The laundry appliance of claim 1, wherein the at least one transducer is disposed within a lifter coupled to the rotating drum.

4. The laundry appliance of claim 3, wherein the lifter includes an ultrasonic drying module that includes a plurality of transducers.

5. The laundry appliance of claim 1, further comprising:

an air handling system having at least one fan, wherein the at least one fan moves the water in the substantially gaseous form from the interior chamber and to an area outside of the rotating drum.

6. The laundry appliance of claim 1, wherein each transducer of the at least one transducer receives power via an inductive coupling.

7. The laundry appliance of claim 6, wherein the inductive coupling is defined by a ferromagnetic portion of the rotating drum and an electromagnetic inductive generator that is positioned outside of the rotating drum.

8. The laundry appliance of claim 1, wherein the at least one transducer includes a plurality of transducers, wherein the plurality of transducers are positioned on at least one of a back wall of the rotating drum and a door of the cabinet, wherein the door at least partially encloses the interior chamber.

9. The laundry appliance of claim 1, wherein the rotating drum includes at least one stationary portion, wherein the at least one transducer is positioned on the at least one stationary portion, and wherein the rotating drum is configured to direct the fabric toward the at least one stationary portion.

10. The laundry appliance of claim 1, wherein the rotating drum is rotationally operable between a continuous rotation and an oscillating partial rotation.

11. The laundry appliance of claim 5, wherein a drain channel is positioned below the rotating drum, wherein the water in the substantially gaseous form collects within the drain channel.

12. The laundry appliance of claim 1, wherein the ultrasonic resonance is generated by a vibrating inner surface of the rotating drum.

13. A laundry appliance comprising:

a cabinet having a fabric treating chamber operably positioned therein for processing fabric;

transducers positioned proximate the fabric treating chamber that provide an ultrasonic resonance that is directed into the fabric treating chamber; and an air handling system that operates cooperatively with the transducers to remove at least humidified air from the fabric treating chamber; wherein the ultrasonic resonance is selectively adjustable between a plurality of operational frequencies that are directed into damp fabric being treated within the fabric treating chamber; and the ultrasonic resonance modifies water trapped within the damp fabric into the humidified air.

14. The laundry appliance of claim 13, wherein the fabric treating chamber is defined within a rotating drum.

15. The laundry appliance of claim 13, wherein the fabric treating chamber is defined between opposing operable plates and the fabric treating chamber defines an adjustable interior volume.

16. The laundry appliance of claim 13, wherein each operational frequency of the plurality of operational frequencies is defined by selective activation of a respective combination of the transducers.

17. The laundry appliance of claim 14, wherein the transducers are positioned within lifters coupled to the rotating drum.

18. A laundry appliance comprising:

a cabinet having a drum operably positioned therein for processing fabric, the drum having a rotational portion and a stationary portion;

a plurality of transducers disposed proximate at least the stationary portion and that provides an ultrasonic resonance that is directed into a fabric treating chamber of the drum; and an air handling system that operates cooperatively with the plurality of transducers and the rotational portion of the drum to remove at least humidified air from the fabric treating chamber; wherein the ultrasonic resonance is adapted to be directed into damp fabric being treated within the fabric treating chamber; and the ultrasonic resonance modifies water trapped within the damp fabric into the humidified air.

19. The laundry appliance of claim 18, wherein the rotational portion of the drum is configured to direct the damp fabric toward the stationary portion, and wherein the stationary portion is sloped toward the rotational portion.

20. The laundry appliance of claim 18, wherein the ultrasonic resonance is generated by a vibrating surface of the drum.

* * * * *